US009541880B2

(12) United States Patent
Ishikura

(10) Patent No.: US 9,541,880 B2
(45) Date of Patent: Jan. 10, 2017

(54) MEDIUM CARRYING DEVICE AND IMAGE FORMING APPARATUS

(71) Applicant: Oki Data Corporation, Tokyo (JP)

(72) Inventor: Hiroki Ishikura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/809,932

(22) Filed: Jul. 27, 2015

(65) Prior Publication Data

US 2016/0091853 A1 Mar. 31, 2016

(30) Foreign Application Priority Data

Sep. 26, 2014 (JP) ..... 2014-196953

(51) Int. Cl.

| | |
|---|---|
| ***B65H 3/06*** | (2006.01) |
| ***G03G 15/00*** | (2006.01) |
| ***B65H 5/06*** | (2006.01) |
| ***B65H 5/16*** | (2006.01) |

(52) U.S. Cl.

CPC ..... *G03G 15/6529* (2013.01); *B65H 3/0669* (2013.01); *B65H 3/0684* (2013.01); *B65H 5/062* (2013.01); *B65H 5/16* (2013.01)

(58) Field of Classification Search

CPC ..... B65H 3/0669; B65H 3/0684; B65H 5/062
See application file for complete search history.

(56) References Cited

U.S. PATENT DOCUMENTS 5,222,724 A * 6/1993 Hirano ..... B65H 3/0623 271/10.11

FOREIGN PATENT DOCUMENTS

JP 2006-008343 A 1/2006
JP 2008169026 A * 7/2008

* cited by examiner

*Primary Examiner* — Luis A Gonzalez
(74) *Attorney, Agent, or Firm* — Muncy, Geissler, Olds & Lowe, P.C.

(57) ABSTRACT

A medium carrying device that carries a medium includes a first roller, a second roller, a rotation transmitting part that drives its rotation by a driving force transmitted from a driving force source, and moves between at a transmitting position and at a releasing position, at the transmitting position, the rotation transmitting part transmits the driving force to the first roller, at the releasing position, the rotation transmitting part does not transmit the driving force, a transmission releasing part that is connected to the rotation transmitting part. When the medium is bowed between the first and second rollers, the transmission releasing part moves the rotation transmitting part from the transmitting position to the releasing position according to the bowing of the medium.

15 Claims, 13 Drawing Sheets

MEDIUM CARRYING DEVICE AND IMAGE FORMING APPARATUS

CROSS REFERENCE

The present application is related to, claims priority from and incorporates by reference Japanese Patent Application No. 2014-196953, filed on Sep. 26, 2014.

TECHNICAL FIELD

This invention relates to a medium carrying device and an image forming apparatus that are preferably applicable to electrophotographic printers (hereafter called printers) for example.

BACKGROUND

Conventionally, a widely-available printer forms a toner image by an exposure device such as an LED head, transfers this onto a medium such as a sheet of paper, and fuses the toner image on the sheet by a fuser, thereby forming an image on the surface of this sheet.

This printer contains in its interior, for example, sheets stacked in a sheet cassette, and forms a carrying path so as to connect sequentially the sheet cassette, the exposure device, the fuser, etc. by a carrying part that carries these sheets. The carrying part comprises, for example, a guide to guide a bill, a roller to transmit a driving force to the bill, etc., sets two rollers that oppose each other across the carrying path of the bill for example as a roller pair, and disposes these roller pairs everywhere along the carrying path (see Patent Document 1 for example).

This printer employs rotating rollers etc. to separate sheets in the sheet cassette into individual sheets and hand each over to the carrying part and carries this sheet by handing it over between roller pairs along the carrying path in the carrying part.

PRIOR ART DOCUMENTS

[Patent Document 1] Japanese Unexamined Patent Application 2006-8343 (FIG. 1)

However, in a printer of such configuration there are cases where a roller pair positioned in the downstream side develops a weaker carrying force than a roller pair positioned in the upstream side of the carrying path due to friction etc. of the rollers. In such a case, there were problems that the printer warps or bows a sheet between the upstream roller pair and the downstream roller pair, which may generate wrinkles and folds on the sheet or cause the sheet jammed in the carrying path.

This invention was made considering the above points and intends to propose a medium carrying device and an image forming apparatus that can stably carry a medium.

SUMMARY

A medium carrying device disclosed in the application includes: a first roller that is rotatable and located at the carrying path to carry the medium along the carrying path, the first roller being an idle roller; a second roller that is rotatable, located at the carrying path and at the downstream side from the first roller in the carrying direction, the second roller driving its rotation by a first driving force transmitted from a first driving force source; a rotation transmitting part that drives its rotation by a second driving force transmitted from a second driving force source, and moves between at a transmitting position and at a releasing position, at the transmitting position, the rotation transmitting part is positioned close to the carrying path in a perpendicular direction with respect to the carrying direction, contacting the first roller, and transmitting the second driving force to the first roller so that the first roller is driven by the second driving force, at the releasing position, the rotation transmitting part is positioned distant from the carrying path in the perpendicular direction with respect to the carrying direction, not contacting the first roller so that the first roller is not driven by the second driving force, a transmission releasing part that is positioned between the first and second rollers in the carrying direction, being connected to the rotation transmitting part. Wherein, when the medium is bowed between the first and second rollers, the transmission releasing part moves the rotation transmitting part from the transmitting position to the releasing position according to the bowing of the medium.

Also, in the image forming apparatus of this invention, an image forming part to form an image on a medium and the above-mentioned medium carrying device are provided.

In this invention, when the medium is bowed, the rotation transmitting part can be moved from the transmitting position according to this bowing of the medium (or a status of the bowed medium) to suspend the transmission of a driving force to the first roller while cancelling the bowing of the medium by continuing carrying by the second roller.

According to this invention, a medium carrying device and an image forming apparatus that can stably carry a medium can be realized.

BRIEF DESCRIPTION OF DRAWINGS

In FIG. 11A, the bias force pushing idle gear 26 downward is generated by a bias part. In FIG. 11B, a pair of magnetic materials are used, one is for idle gear 26, the other is placed on or beneath a medium carry path. The magnetic bias force works between the pair of the magnetic materials, attracting each other.

DETAILED EMBODIMENTS

Below, detailed embodiments of the invention (hereafter called embodiments) will be explained referring to drawings.

1. First Embodiment

1-1. Configuration of a Color Printer

Figure 1:
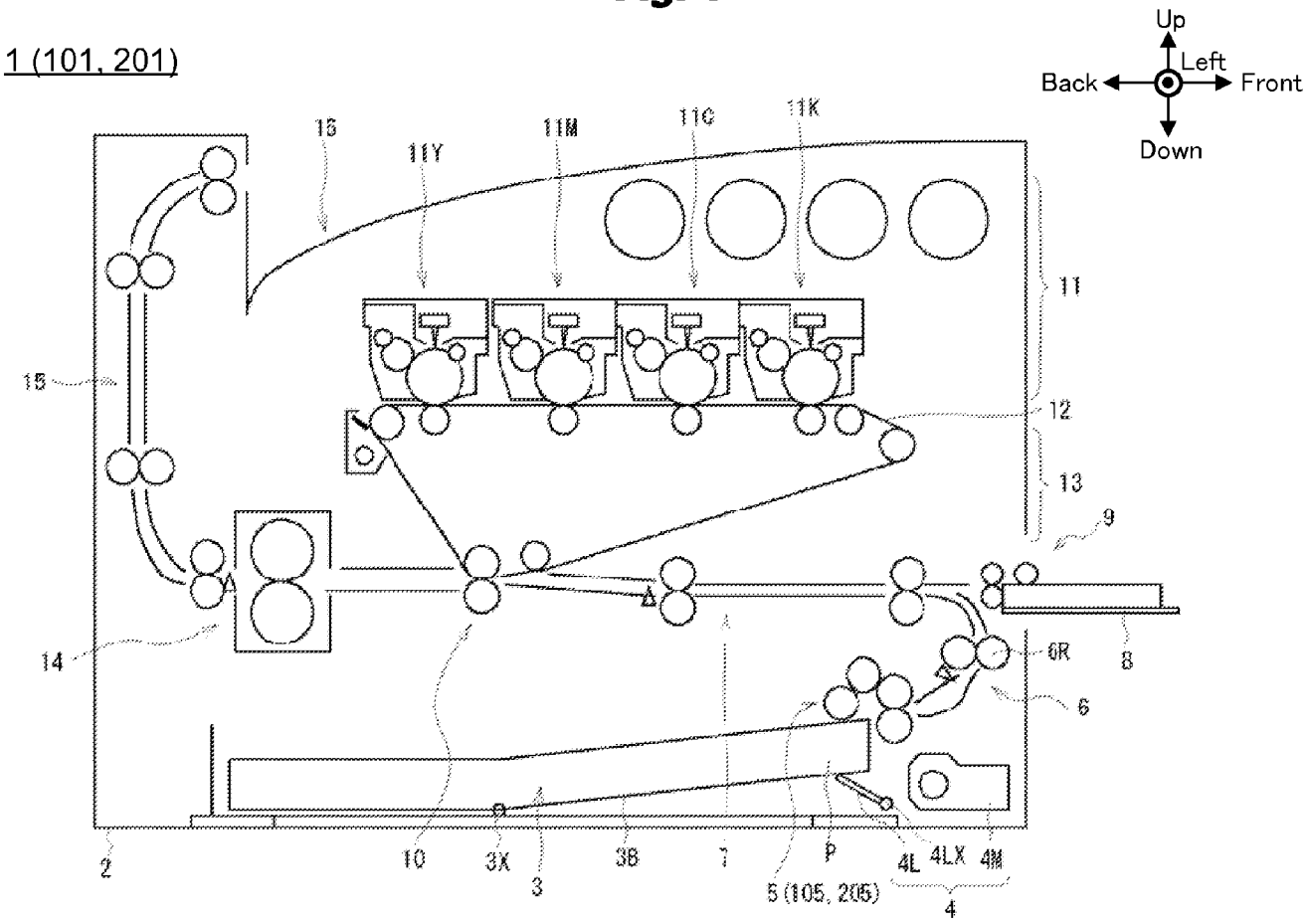
FIG. 1 is a schematic diagram showing the configuration of an image forming apparatus.

As its left side view is shown in FIG. 1, an image forming apparatus 1 by the first embodiment is a color electrophotographic printer designed to print a desired color image on a sheet P that is A3 or A4 in size for example and has flexibility.

The image forming apparatus 1 has a variety of parts disposed inside a chassis 2 formed approximately in a box shape. Incidentally, the following explanations will be made by assuming the right end in FIG. 1 as the front face of the image forming apparatus 1 and defining the up and down directions, the left and right directions, and front and back directions, respectively, viewed by facing with this front face.

This image forming apparatus 1 controls the whole in an integrated manner by a control part (not shown). The control part is connected wirelessly or wired with a host device (not shown) such as a personal computer. Also, when provided with an image data expressing a color image for printing and instructed to print the color image by the host device, the control part executes a print process to form a print image on the surface of the sheet P.

In the bottom portion inside the chassis 2 a sheet feeding cassette 3 that contains the sheets P is provided. The sheet feeding cassette 3 is formed in a hollow rectangular parallelepiped shape for example, and its top face is open. Also, a sheet loading plate 3B is provided over an about 60-70% area of the front side of the bottom part of the sheet feeding cassette 3. The rear end of the sheet loading plate 3B is rotatably attached via a rotation shaft 3X to the sheet feeding cassette 3. Many sheets P are contained in a stacked state in this sheet feeding cassette 3.

A lifting part 4 is provided in the front side of the sheet feeding cassette 3. The lifting part 4 has a motor 4M to generate a driving force and a lifting lever 4L. The lifting lever 4L has its rear end positioned below the vicinity of the front end of the sheet loading plate 3B and is configured rotatable centering on a rotation shaft 4LX provided on its front end. This lifting part 4 generates a driving force by rotating the motor 4M based on the control from the control part, transmits the driving force to the lifting lever 4L via a specified gear (not shown), and rotates it to lift up its rear end. By this the lifting part 4 can lift up the front end of the sheet loading plate 3B and also lift up the front end of the sheet P placed on the upper side as well.

In the upper front direction of the sheet feeding cassette 3, a sheet feeding part 5 is provided. The sheet feeding part 5 is configured of multiple rollers etc. and designed to separate only one top sheet of the sheet P from the other sheets P contained in the sheet feeding cassette 3 and feed it in the front obliquely upward direction (the details will be described later).

In the front side through the upper side of the sheet feeding part 5, a lower carrying part 6 is provided to carry the sheet P. The lower carrying part 6 forms a carrying path where the sheet P handed over from the sheet feeding part 5 advances in the front upward direction by a guide that guides the sheet P and later turns backward. Also, provided in the lower carrying part 6 is a carrying roller pair 6R comprising two carrying rollers opposing each other across the carrying path. These carrying roller pair 6R rotate in specified directions with a driving force supplied by an unshown motor and carry the sheet P upward along the carrying path, thereby handing this sheet P to a middle carrying part 7.

The middle carrying part 7 is configured of a guide that guides the sheet P and multiple roller pairs in the same manner as the lower carrying part 6. This middle carrying part 7 forms the carrying path of the sheet P in a linear shape that cut across in the front-back direction as shown in the drawings (or horizontal direction) inside the chassis 2. Also, in somewhat back side of the center in the front-back direction in the middle carrying part 7, a transfer part 10 is provided.

In the front side of the middle carrying part 7, a multipurpose tray 8 is provided at a position protruding forward from the front face of the chassis 2. The multipurpose tray 8 is formed in a plate shape with its plate face oriented in the up-down direction as shown in the drawings (or vertical direction), and the sheet P is placed on its upper surface. In the vicinity of the rear end of the multipurpose tray 8, a multipurpose feeding part 9 is provided. The multipurpose feeding part 9 is configured in the same manner as the sheet feeding part 5 so as to separate the sheets P placed on the multipurpose tray 8 into individual sheets, feed one sheet at a time, and hand it over to the middle carrying part 7 toward the back. This multipurpose tray 8 is utilized when feeding the sheets P of infrequently-used size or kind for example.

Above the middle carrying part 7, an image forming part 11 is provided. The image forming part 11 has four process units 11Y, 11M, 11C, and 11K that form images in yellow (Y), magenta (M), cyan (C), and black (K) colors, respectively.

Between the image forming part 11 and the middle carrying part 7, a belt running part 13 is provided to run an intermediate transfer belt 12 made of a wide endless belt. This belt running part 13 has the intermediate transfer belt 12 stretched around multiple rollers, makes rollers of the process units 11Y, 11M, 11C, and 11K contact with the intermediate transfer belt 12 in its upper portion, and also makes the intermediate transfer belt 12 contact with the carrying path of the sheet P in its lower portion inside the transfer part 10.

Once a respective image data is supplied from the control part, each of the process units 11Y, 11M, 11C, and 11K of the image forming part 11 forms a toner image according to this image data. The belt running part 13, by running the intermediate transfer belt 12, sequentially transfers toner images of individual colors formed by the individual process units 11Y, 11M, 11C, and 11K onto the intermediate transfer belt 12 and makes these transferred toner images advance to the transfer part 10. The transfer part 10 transfers the toner images from the intermediate transfer belt 12 onto the sheet P.

The middle carrying part 7 carries the sheet P with the toner images transferred toward the back and advances it into the fuser part 14. The fuser part 14 fuses toner onto the sheet P by applying heat and pressure to the sheet P and toner while rotating in a specified direction a pair of rollers disposed above and below the carrying path and advances this sheet P further backward. By this, an image based on the image data is formed on the sheet P.

In the back through the above of the fuser 14, an upper carrying part 15 is provided. The upper carrying part 15 is configured of a guide that guides the sheet P and multiple roller pairs in the same manner as the lower carrying part 6 and the middle carrying part 7. This upper carrying part 15 forms a carrying path where the sheet P handed over from the front-side fuser part 14 at the lower end is advanced upward and sent out forward in the vicinity of the upper end. Also, in the front side at the upper end of the upper carrying part 15 on the top surface of the chassis 2, a stacker part 16 is provided to stack the sheet P with an image formed. This upper carrying part 15 carries the sheet P handed over from the fuser part 14 upward along the carrying path and discharges it forward to stack the sheet P in the stacker part 16.

In this manner, the image forming apparatus 1 is designed to form an image on the sheet P by feeding the sheet P contained in the sheet feeding cassette 3 by the sheet feeding part 5 and transferring and fusing the toner image while carrying it sequentially by the lower carrying part 6, the middle carrying part 7, and the upper carrying part 15.

1-2. Configuration of the Sheet Feeding Part

Figure 2A:
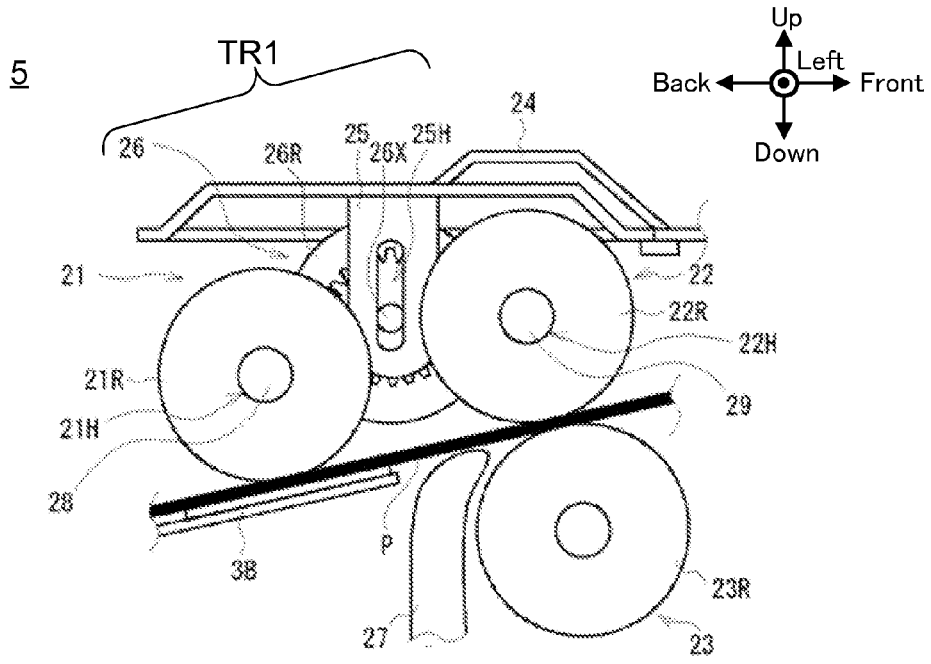
FIGS. 2A-B are schematic diagrams showing the configuration of a sheet feeding part by the first embodiment. The figures illustrate a rotation transmitting part in a transmitting position in which a driving force is conveyed to a pickup roller (first roller).

Next, the configuration of the sheet feeding part 5 will be explained. As a schematic left side view is shown in FIG. 2A, the sheet feeding part 5 is configured of multiple rollers such as a pickup roller 21, a feed roller 22, and a retard roller 23, a frame 24, supporting arms 25, an idle gear 26, and a sheet guide 27.

Figure 3:
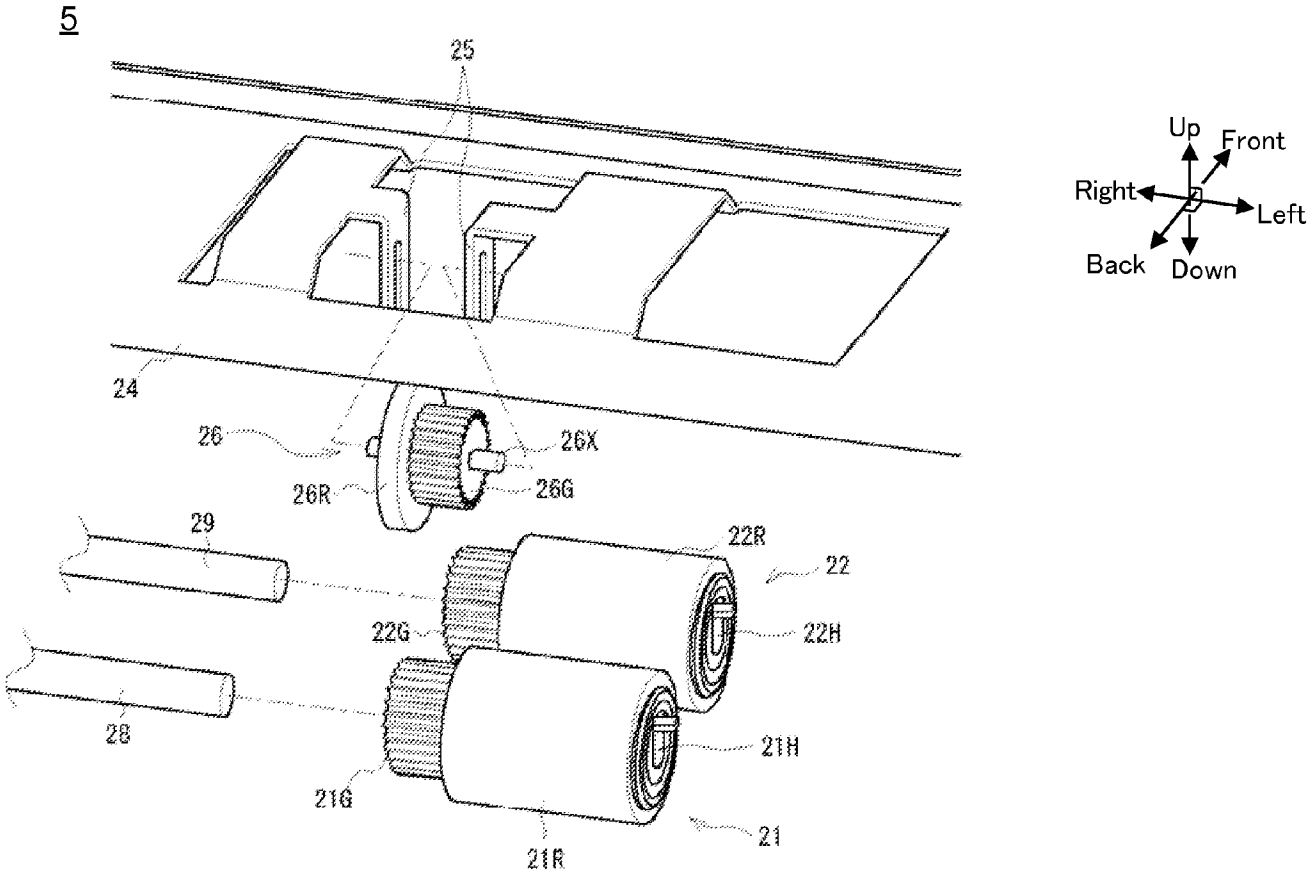
FIG. 3 is a schematic perspective diagram showing the configuration of the sheet feeding part by the first embodiment.

As its perspective view is shown in FIG. 3, the pickup roller 21 as the first roller is configured of a cylindrical roller part 21R with its central axis in the left-right direction as shown in the drawings (or perpendicular direction penetrating the sheet from the front side to the back side) and a cogwheel-shaped gear part 21G provided on the right side of the roller part 21R. For the outer circumference part of the roller part 21R, a material such as rubber having a high friction coefficient for the sheet P is used.

Also, the pickup roller 21 has a central hole 21H bored to penetrate the centers of the roller part 21R and the gear part 21G in the left-right direction. A shaft 28 supported rotatable by the chassis 2 (FIG. 1) is inserted to the central hole 21H. By this, the pickup roller 21 is rotatably supported at a position to make the vicinity of the lower end of the roller part 21R contact with the carrying path of the sheet P.

By such a configuration, the pickup roller 21 rotates centering on the shaft 28 when a driving force is transmitted from another gear engaging with the gear part 21G and stops rotation when the transmission of this driving force stops.

Figure 12:
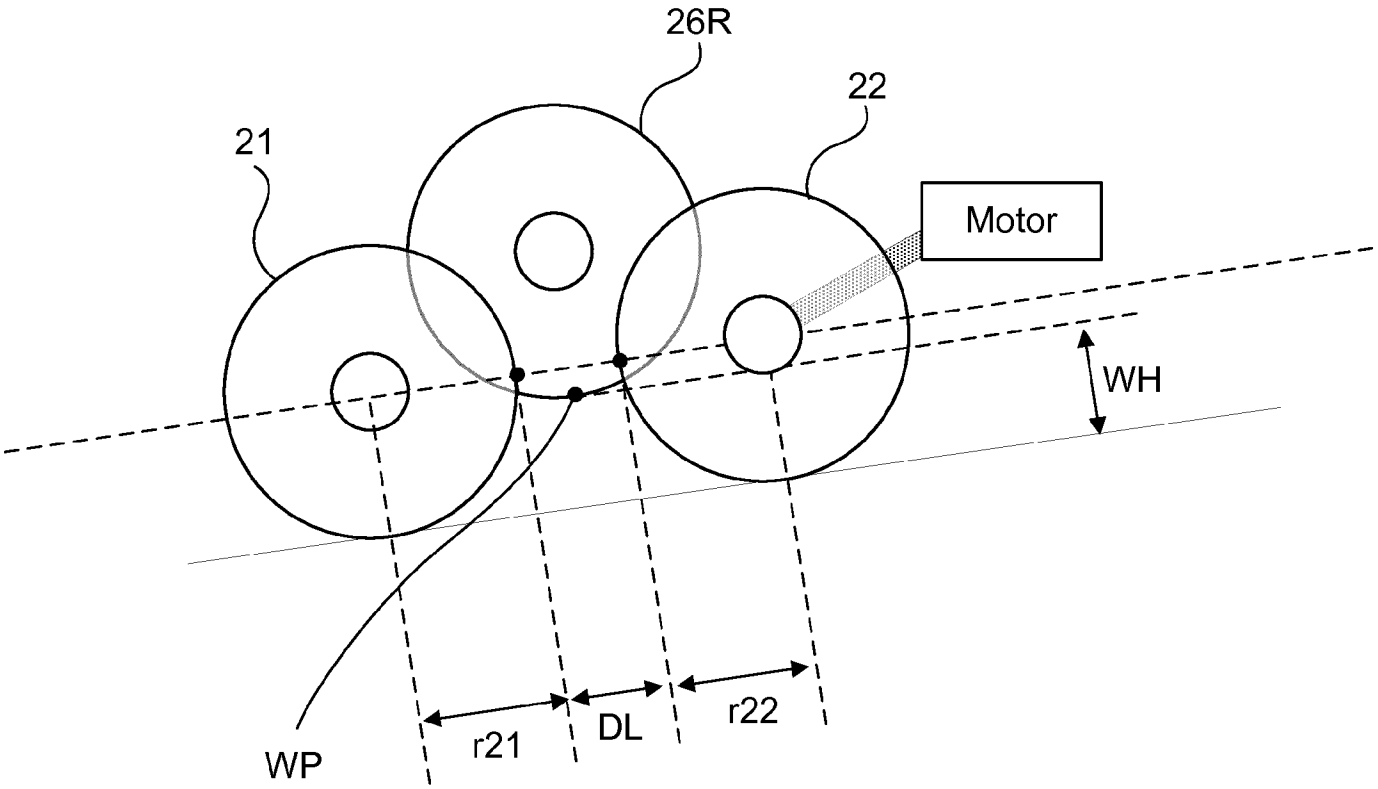
FIG. 12 is a schematic diagram illustrating positional relationship between rollers (21, 22, 26R). A first driving force to roller 22 (as the second roller) is generated by the motor. A second driving force to roller 21 (as the first roller) is transmitted from the roller 21 via idle gear 26 (as a rotation transmitting part).

The feed roller 22 as the second roller is configured of a roller part 22R and a gear part 22G in the same manner as the pickup roller 21, and a central hole 22H that penetrates n the left-right direction is bored. To this central hole 22H, a shaft 29 rotatably supported by the chassis 2 is inserted in the same manner as the shaft 28. By this, the feed roller 22 is rotatably supported at a position where the vicinity of the lower end of the roller part 22R is made contact with the carrying path of the sheet P in the same manner as the pickup roller 21. Incidentally, the shaft 29 is positioned in the front-upper side of the shaft 28 and makes the pickup roller 21 and the feed roller 22 positioned in somewhat separated places from each other in the front-back direction. The separation distance between the rollers 21 and 22 is denoted with DL in FIG. 12. The distance DL is to be determined considering the sizes of rollers (for example radiuses r21 and r22), a height of the roller 26R from the carrying path, power of the motor, a required friction force between these rollers and the carried medium etc. The height of the roller 26R is considered as a height from the sheet to a working point (WP) where the bowed sheet contacts and at which the roller is pushed upward by the bowed sheet. The working part WP is not necessary to be on an outer surface of a roller. As shown in FIG. 8B, when contact part 231, which projects downward, is adopted for the transmission releasing, the lowest point of the contact part 231 is considered as the working point WP. Also, the feed roller 22 is provided with a driving force to the gear part 22G from a motor in that figure. This motor generates a driving force based on the control of above-mentioned control part. The motor as the driving force source is illustrated in FIG. 12. The motor is connected to the shaft of the feed roller 22, providing the driving force to the roller.

By such a configuration, the feed roller 22 rotates centering on the shaft 29 when a driving force is transmitted from the motor to the gear part 22G, and stops rotation when the transmission of the driving force from this motor stops. Further, the feed roller 22 has a built-in one-way clutch (not shown) that allows free rotation only in one direction and regulates rotation in the reverse direction. By this, the feed roller 22 can freely idle only when such an external force is applied as to rotate the roller part 22R in a specified direction even in a state that no driving force is transmitted to the gear part 22G.

The retard roller 23 as the third roller is positioned on the opposite side of the feed roller 22 across the carrying path of the sheet P, in other words, somewhat toward the front below the feed roller 22. This retard roller 23 is configured of a roller part 23R configured in the similar cylindrical shape to the roller part 22R of the feed roller 22 and a torque generation part 23T (FIG. 2B) that generates rotation torque in a specified direction. This torque generation part 23T is attached to the chassis 2 by an unshown attaching member.

Because of this, the retard roller 23 generates rotation torque by the torque generation part 23T based on the control of the control part (not shown) and transmits it to a roller part 23R to rotate the roller part 23R.

On the other hand, a frame 24 is attached to the chassis 2 (FIG. 1) and positioned above the pickup roller 21 and the feed roller 22. This frame 24 has two supporting arms 25 provided erect separated by a specified interval in the left-right direction. Each of these supporting arms 25 are formed in a plate shape that is long in the up-down direction and think in the left-right direction as the whole. In about the middle in the front-back direction of each of these supporting arms, an insertion hole 25H made of a thin, vertically-long hole is formed so as to penetrate in the left-right direction.

The idle gear 26 is configured of a cogwheel-shaped gear part 26G, a roller part 26R, and a rotation shaft 26X. The gear 26G as the rotation transmitting part is configured as a cogwheel with its central axis oriented in the left-right direction in the same manner as the gear 21G of the pickup roller 21 and the gear part 22G of the feed roller 22. The roller part 26R is formed in a thin cylindrical shape with its central axis oriented in the left-right direction and contacts with the right side of the gear part 26G with their central axes aligned. Also, the outer diameter of the roller part 26R is made larger than the outer diameter of the gear part 26G. The rotation shaft 26X is also formed in a thin and long cylindrical shape with its central axis oriented in the left-right direction and penetrates the center of the gear part 26G and the roller part 26R along the left-right direction.

This idle gear 26 is sandwiched between two supporting arms 25 with both left and right sides of the rotation shaft 26X inserted to the insertion holes 25H, respectively. By this, the idle gear 26 can freely rotate with the rotation shaft 26X as its rotation center. Along with this, the idle gear 26 can also freely move in the up-down direction within the range where the rotation shaft 26X is inserted to the insertion hole 25H.

Each supporting arm 25 has its respective insertion hole 25H positioned in about the middle between the shat 28 to which the pickup roller 21 is inserted and the shaft 29 to which the feed roller 22 is inserted. Also, when sandwiching the idle gear 26, each supporting arm 25 approximately aligns the position of the gear part 26G in the left-right direction with both the gear part 21G of the pickup roller 21 and the gear part 22G of the feed roller 22.

Figure 2B:
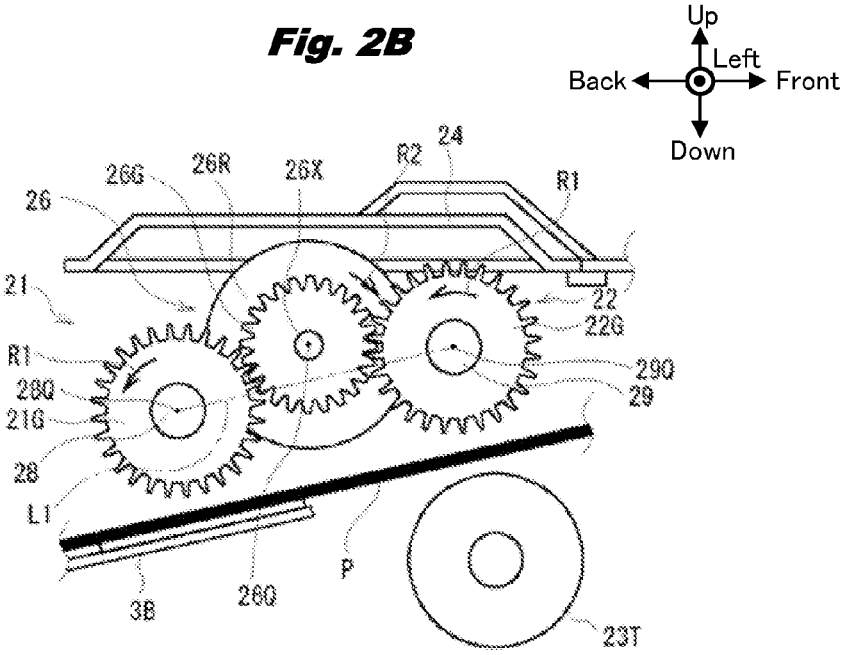

The idle gear 26 tries to descend by the action of gravity within the range where the rotation shaft 26X is restricted to the insertion hole 25H. As the result, as shown in FIG. 2B, the idle gear 26 has the gear part 26G engage with the gear part 22G of the feed roller 22 and the gear part 21G of the pickup roller 21, respectively, and stops at a position where a driving force can be transmitted. Hereafter, the position of the idle gear 26 in that state is also called a transmitting position. Incidentally, FIG. 2B depicts a state where the roller parts 21R and 22R and the front-side (in other words, the left-side) supporting arm 25 are omitted from FIG. 2A.

Also, the positions of the shafts 28 and 29 are adjusted so as to make the interval between the gear part 22G of the feed roller 22 and the gear part 21G of the pickup roller 21 smaller than the diameter of the gear part 26G in the idle gear 26. Specifically, the length of a virtual line L1 connecting the central point 28Q of the shaft 28 and the central point 29Q of the shaft 29 is made smaller than the total length (accumulated values) of the diameter of the gear part 26G in the idle gear 26, the radius of the gear part 22G in the feed roller 22, and the radius of the gear part 21G in the pickup roller 21. Therefore, when the idle gear 26 is at the transmitting position, the central point 26Q of the rotation shaft 26X is positioned above the line L1 connecting the central point 28Q and the central point 29Q.

The sheet guide 27 is positioned behind the retard roller 23 and positions its upper end slightly below the carrying path of the sheet P. By this, the sheet guide 27 can prevent the sheet P from progressing greatly deviated below the carrying path of the sheet P.

In this manner, the sheet feeding part 5 has multiple rollers disposed in the vicinity of the carrying path of the sheet P, and also has the supporting arm 25 support the idle gear 26 so as to rotate and move in the up-down direction freely.

1-3. Engagement of the Idle Gear

Next, the engagement of the gear part 26G of the idle gear 26 with the gear part 22G of the feed roller 22 and the gear part 21G of the pickup roller 21 in the sheet feeding part 5 will be explained.

As shown in FIG. 2B, when it is at the transmitting position, the idle gear 26 has the gear part 26G engaged with both the gear part 22G of the feed roller 22 and the gear part 21G of the pickup roller 21. Therefore, when a driving force is transmitted from an unshown motor to the gear part 22G of the feed roller 22, the sheet feeding part 5 transmits this driving force to the gear part 26G and the gear part 21G sequentially.

At this time, as shown in FIG. 2B, the sheet feeding part 5 rotates the feed roller 22 in the arrow R1 direction, the idle gear 26 in the arrow R2 direction, and further the pickup roller 21 in the arrow R1 direction. By this, the sheet feeding part 5 can have the pickup roller 21 apply a force in the front obliquely upward direction against the sheet P, and further has the feed roller 22 apply a force in the front obliquely upward direction in its downstream side.

Incidentally, when feeding the sheet P, the sheet feeding part 5 can feed it without bowing the sheet P by making the carrying force applied from the downstream-side feed roller 22 the same as or greater than the carrying force applied from the upstream-side pickup roller 21 to the sheet P. Below, those carrying forces will be called the upstream-side carrying force and the downstream-side carrying force.

Figure 4A:
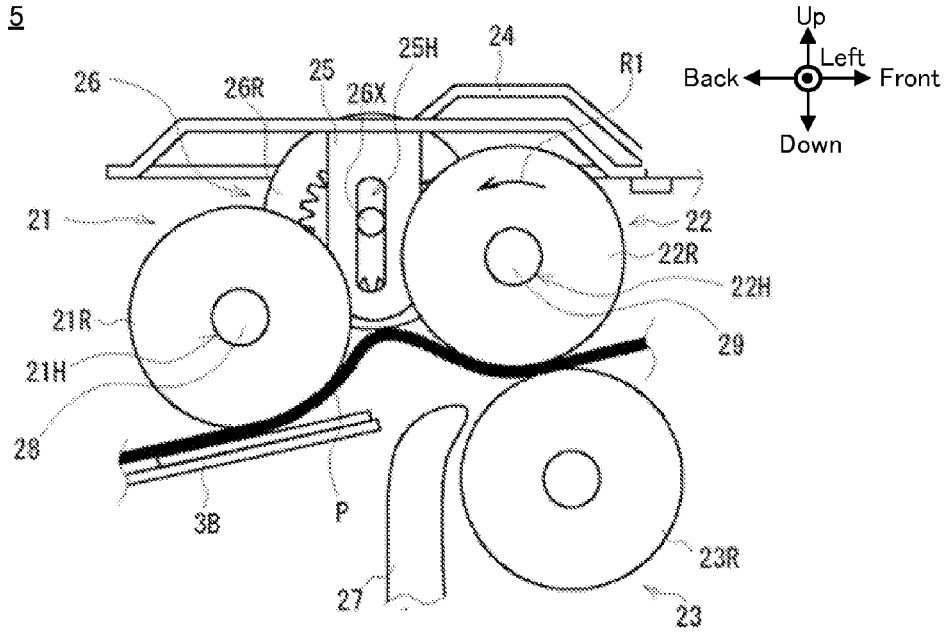
FIGS. 4A-B are schematic diagrams showing suspension of the transmission of a driving force by the first embodiment. The figures illustrate the rotation transmitting part in a releasing position in which the driving force is not conveyed to the pickup roller.
Figure 4B:
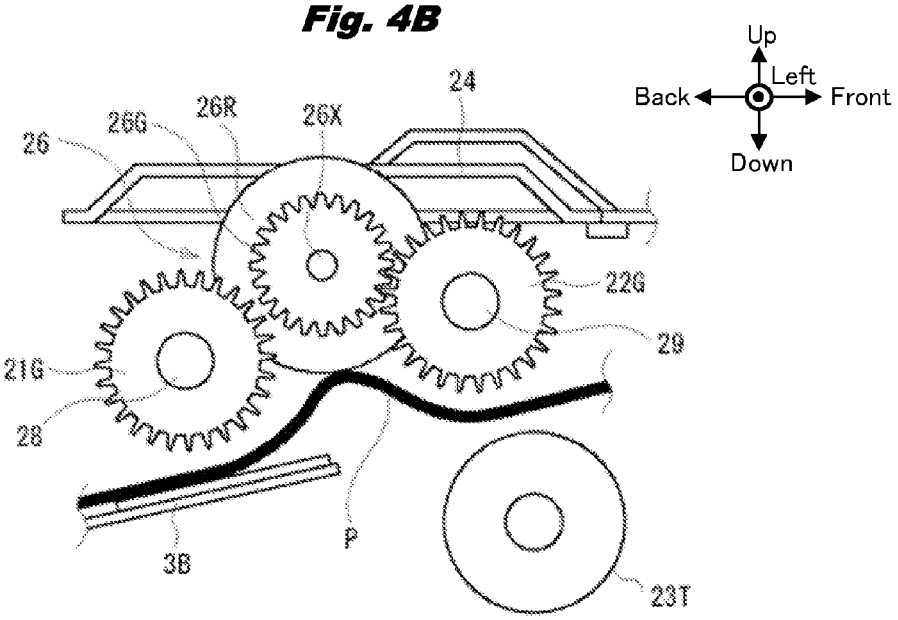

However, in the sheet feeding part 5, there are cases where the downstream-side carrying force becomes smaller than the upstream-side carrying force due to such causes as frictions of the rollers and manufacturing errors. In such a case, in the sheet feeding part 5 the sheet P may be bowed (or so-called be humped) between the contact place with the pickup roller 21 and the contact place with the feed roller 22, in other words, below the idle gear 26 as shown in FIGS. 4A and 4B corresponding to FIG. 2A and. Incidentally, in the sheet feeding part 5, because the sheet loading plate 3B and the sheet guide 27 are positioned right under the carrying path of the sheet P, the bowed portion is formed above the carrying path.

Here, in the sheet feeding part 5, when the bowing (or hump) of the sheet P increases to some extent, the upper end of the bowed portion of the sheet P contacts with the lower end or the vicinity of the roller part 26R of the idle gear 26 and applies an upward force to the idle gear 26. At this time, the idle gear 26 has the rotation shaft 26X move upward along the insertion hole 25H of the supporting arm 25 to release the engagement of the gear part 26G and the gear part 21G of the pickup roller 21 as shown in FIG. 4B and stop the transmission of a driving force to the gear part 21G.

In other words, the sheet feeding part 5 releases the transmission of a driving force from the gear part 26G to the gear part 21G of the pickup roller 21 according to the bowing of the sheet P by the roller part 26R of the idle gear 26, the rotation shaft 26X, the supporting arm 25, and the insertion hole 25H (hereafter, altogether called the transmission releasing part TR1). The position of the rotation transmitting part is defined as a releasing position.

Then, because the transmission of the driving force stops, the pickup roller 21 stops rotating and stops applying the carrying force to the sheet P. On the other hand, because the driving force continues to be transmitted from the motor, the feed roller 22 continues to rotate in the arrow R1 direction and continues to apply the carrying force to the sheet P. In other words, the sheet feeding part 5 keeps reducing the bowing of the sheet P by stopping the rotation of the pickup roller 21 and continuing the rotation of the feed roller 22. Accompanying this, the sheet feeding part 5 lowers the idle gear 26 lifted up by the sheet P, moving it closer to the transmitting position.

In due course, once the bowing of the sheet P has become sufficiently small, the sheet feeding part 5 lowers the idle gear 26 to the transmitting position (FIGS. 2A and 2B) and reengages the gear part 26G with the gear part 21G of the pickup roller 21. By this, the sheet feeding part 5 resumes the transmission of the driving force from the gear part 26G to the gear part 21G and resumes the rotation of the pickup roller 21.

In this manner, the sheet feeding part 5 is designed, when the sheet P has been bowed, to lift up the idle gear 26 from the transmitting position by this bowed portion of the sheet P and release the engagement of the gear part 26G and the gear part 21G of the pickup roller 21.

1-4. Actions and Effects

In the above configuration, the sheet feeding part 5 of the image forming apparatus 1 of the first embodiment is designed so that the idle gear 26 transmitting a driving force from the feed roller 22 to the pickup roller 21 is held movable in the up-down direction by the supporting arm 25 and releases the transmission of the driving force to the pickup roller 21 when lifted up from the transmitting position.

Therefore, when the downstream-side carrying force by the feed roller 22 has become smaller than the upstream-side carrying force by the pickup roller 21 and the sheet P has been bowed, the sheet feeding part 5 can have this bowed portion lift up the idle gear 26 from the transmitting position and suspend the transmission of the driving force to the pickup roller 21.

By this, the sheet feeding part 5 can halt the rotation of the upstream-side pickup roller 21 and continue the rotation of the downstream-side feed roller 22, which allows cancelling the bowing of the sheet P. In due course, once the bowing of the sheet P has become sufficiently small and the idle gear 26 has returned to the transmitting position, the sheet feeding part 5 can resume the transmission of the driving force to the pickup roller 21 and rotate it.

In other words, even if the sheet P has temporarily been bowed, because the sheet feeding part 5 can cancel this at any time, the occurrence of wrinkles, folds, etc. of the sheet P and jamming of the sheet P can be prevented, and the sheet P can be stably fed and carried. As the result, in the image forming apparatus 1, a high quality image can be formed on a smooth sheet P carried stably.

To rephrase this, the sheet feeding part 5 can switch whether to transmit a driving force to the pickup roller 21 by temporarily lifting up the idle gear 26 by utilizing the rigidity possessed by the bowed portion created of the sheet P and also lowering it.

Therefore, the sheet feeding part 5 can significantly simplify its configuration and extremely simplify its operation in comparison with a mechanism that the bowing is canceled by controlling the rotations of the rollers using a sensor for detecting the bowing of the sheet P and multiple motors for controlling the rotation speeds of the pickup roller 21 and the fee roller 22 independently from each other for example.

Also, even in comparison with the conventional configuration that the idle gear 26 does not move in the up-down direction, because the sheet feeding part 5 only needs to install the insertion hole 25H made of a long hole on the supporting arm 25 and also install the roller part 26R on the idle gear 26, the changes or increase of the component parts become very small, which can suppress the increase in the manufacturing cost as extremely small.

Furthermore, the sheet feeding part 5 provided the roller part 26R having a larger diameter than the gear 26G in the idle gear 26 and made the bowed portion of the sheet P contact with the roller part 26R. Therefore, the sheet feeding part 5 can prevent damage, adherence of dirt, etc. due to the sheet P contacting with the gear part 26G.

Furthermore, the sheet feeding part 5 set the direction to move the idle gear 26 from the transmitting position when the sheet P has been bowed as the upward direction. By this, the sheet feeding part 5 can utilize the action of gravity when the idle gear 26 returns from the lifted-up position to the transmitting position, eliminating the need of using a bias member such as a spring and suppressing complication of the configuration.

In addition, the sheet feeding part 5 set the direction to rotate the feed roller 22 as the arrow R1 direction. In other words, the feed roller 22 is set to transmit a downward driving force to the front-side portion of the idle gear 26 positioned in the back side. Therefore, even when the sheet P has been bowed and the idle gear 26 is lifted upward from the transmitting position, the sheet feeding part 5 can apply a downward driving force, that is a direction to return to the transmitting position, from the gear part 22G of the feed roller to the front-side portion of the gear part 26G of the idle gear 26. By this, when the idle gear 26 is lifted upward from the transmitting position, the sheet feeding part 5 can utilize a part of the driving force as a force to lower the idle gear 26, and by combining it with the action of gravity, can securely return the idle gear 26 to the transmitting position.

By the way, the sheet feeding part 5 has the gear part 22G of the feed roller 22 apply a downward force to and tries to lower the idle gear 26 via the gear part 26G. Then, the sheet feeding part 5 optimizes the interval between the shaft 28 and the shaft 29 to position the central point 26Q above the virtual line L1 connecting the central points 28Q and 29Q when the idle gear 26 is at the transmitting position (FIG. 2B).

Therefore, the sheet feeding part 5 can support the gear part 26G sandwiched from obliquely below in the front and the back by the gear part 22G of the feed roller 22 and the gear part 21G of the pickup roller 21 and can suppress descending of the idle gear 26 from the transmitting position. By this, the sheet feeding part 5 can structurally avoid occurrence of such a problem that the gear part 26G moves away from and does not engage with the gear part 21G of the pickup roller 21 by the driving force from the gear 22G of the feed roller 22 and becomes unable to transmit the driving force, which could occur when the central point 26Q of the idle gear 26 has descended below the line L1.

Furthermore, the sheet feeding part 5 positioned the sheet loading plate 3B and the sheet guide 27 right under the carrying path to have a bowing of the sheet P only toward the upper side of the carrying path. Therefore, the sheet feeding part 5 can securely prevent occurrence of such a problem that the engagement of the gear part 26G of the idle gear 26 and the gear part 21G of the pickup roller 21 cannot be released due to the sheet P bowing toward the lower side of the carrying path.

According to the above configuration, when the sheet P has been bowed, the sheet feeding part 5 of the image forming apparatus 1 of the first embodiment has this bowed portion lift the idle gear 26 upward from the transmitting position and suspend the transmission of the driving force to the pickup roller 21. By this, the sheet feeding part 5 halts the rotation of the upstream-side pickup roller 21 and continues the rotation of the downstream-side feed roller 22, which allows cancelling the bowing of the sheet P to prevent damages or jamming of the sheet P for stable feeding.

2. Second Embodiment

In comparison with the image forming apparatus 1 by the first embodiment, although an image forming apparatus 101 (FIG. 1) by the second embodiment is different in having a sheet feeding part 105 replacing the sheet feeding part 5, it is configured in the same manner in the other respects.

2-1. Configuration of the Sheet Feeding Part

Figure 5A:
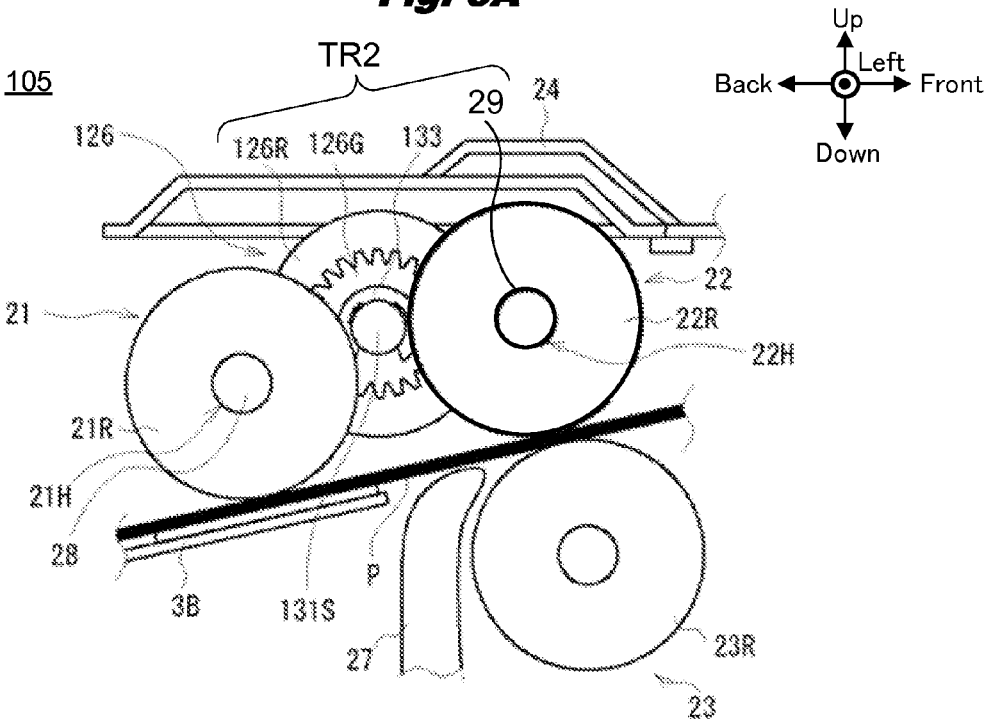
FIGS. 5A-B are schematic diagrams showing the configuration of a sheet feeding part by the second embodiment. The figures illustrate another rotation transmitting part in the transmitting position.
Figure 5B:
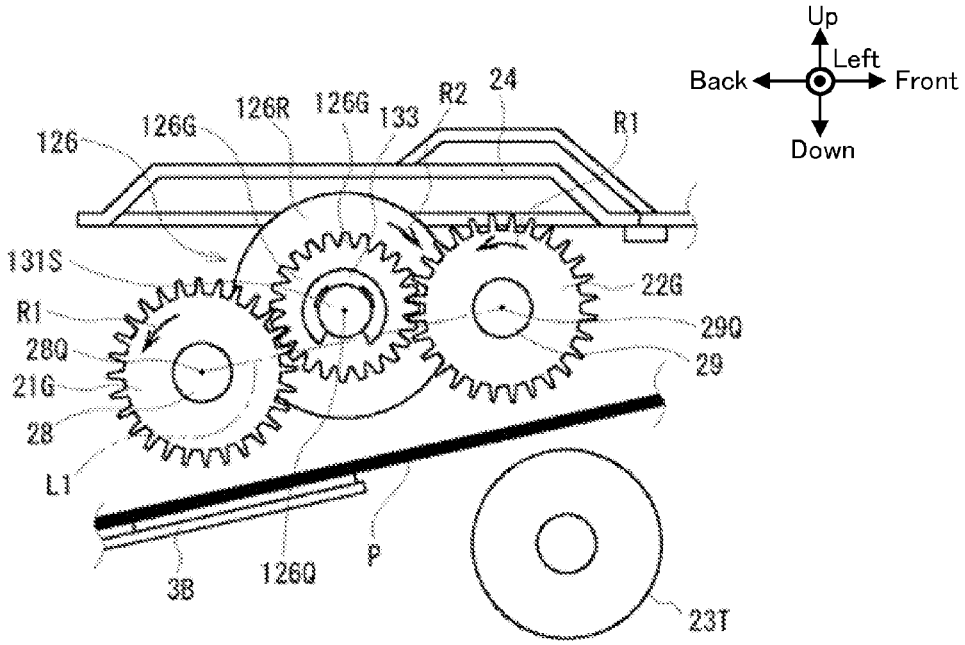
Figure 6A:
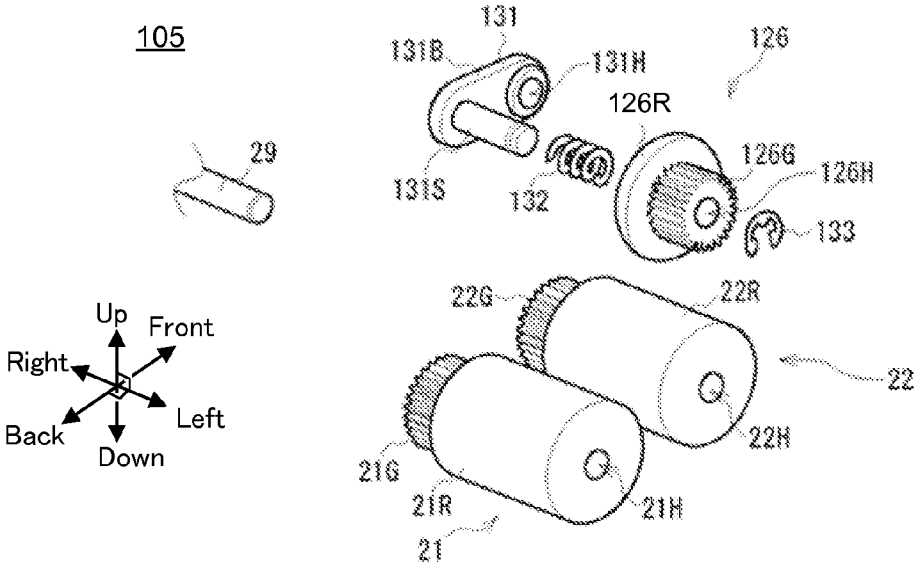
FIGS. 6A-C are schematic perspective diagrams showing the configuration of the sheet feeding part by the second embodiment.
Figure 6B:
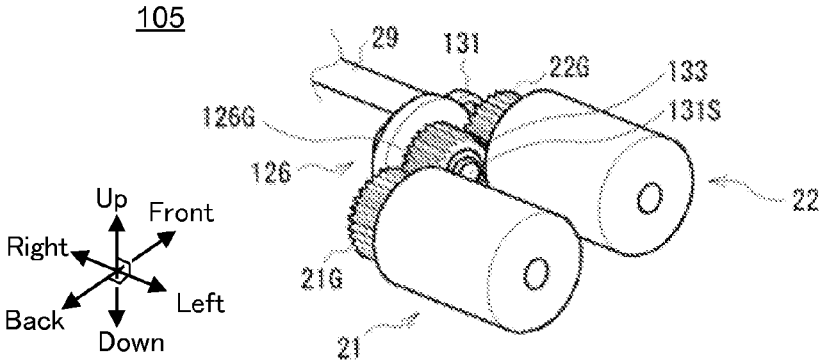
Figure 6C:
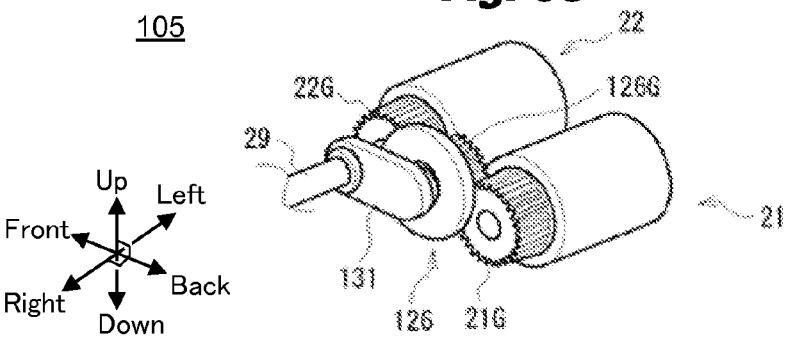

As shown in FIGS. 5A-5B and FIGS. 6A-6B corresponding to FIGS. 2A-2B and FIG. 3, in comparison with the sheet feeding part 5, although the sheet feeding part 105 is different in having an idle gear 126 replacing the idle gear 26, an swing holder 131 replacing the supporting arm 25, a spring 132, and a stopper 133, it is configured in the same manner in the other respects. Incidentally, FIG. 6A shows a state disassembled into individual parts, and FIGS. 6B and 6C states that the parts are assembled, viewed from different directions from each other.

In comparison with the idle gear 26, the idle gear 126 has a roller part 126R and a gear part 126G corresponding to the roller part 26R and the gear part 26G, respectively. On the other hand, the idle gear 126 has a central hole 126H bored to penetrate in the left-right direction replacing the rotation shaft 26X.

The swing holder 131 as the swing body is configured centering on a base part 131B formed in a thin plate shape in the left-right direction. The base part 131B is formed in an elliptic shape having the front-back direction as the longitudinal direction seen from the left-right direction. On the front side of the base part 131B, a hole 131H made of a round hole penetrating in the left-right direction is bored. To this hole 131H, a shaft 29 is inserted. In other words, to the shaft 29, the swing holder 131 and the feed roller 29 are inserted sequentially from the right. By this, the swing holder 131 can freely rotate centering on the shaft 29.

In the back side of the base part 131B, a cylindrical rotation shaft 131S having a similar diameter to that of the shaft 29 is perpendicularly provided from the left side face toward the left. To the rotation shaft 131S as a rotation supporting part, the spring 132 made of a coil spring and an idle gear 126 are inserted, and to the vicinity of the left end, the stopper 133 as a fixing part is attached. The spring 132 as a frictional action part is inserted in a state compressed from its natural state in the left-right direction, and by its recovering force, biases the base part 131B and the idle gear 126 toward separating in the left-right direction. By this, the idle gear 126 can freely rotate centering on the rotation shaft 131S and always in a state pressed onto the stopper 133. In other words, the idle gear 126 generates a certain degree of frictional force with the stopper 133.

Also, the base part 131B has an appropriate interval set between the hole 131H to which the shaft 29 is inserted and the rotation shaft 131S to which the idle gear 126 is inserted. By this, as shown in FIG. 5 (B), the swing holder 131 always keeps the gear part 22G of the feed roller 22 and the gear part 126G of the idle gear 126 in an engaged state.

Here, as stated above, the swing holder 131 can rotate centering on the shaft 29 and transmit a driving force by engaging the gear part 126G of the idle gear 126 with the gear part 21G of the pickup roller 21 by positioning the rotation shaft 131S in the back side of the shaft 29 as shown in FIG. 5B. Below, the position of the idle gear 126 is called the transmitting position in this embodiment. At this time, the central point 131Q of the rotation shaft 131S is positioned above the virtual line L1 connecting the central point 28Q of the shaft 28 and the central point 29Q of the shaft 29 in the same manner as the central point 26Q of the rotation shaft 26X in the first embodiment.

In this manner, the sheet feeding part 105 disposes multiple rollers in the vicinity of the carrying path of the sheet P and has the swing holder 131 support the idle gear 126 rotatable and movable in the direction toward rotating centering on the shaft 29.

2-2. Engagement of the Idle Gear

Next, the engagement of the gear part 126G of the idle gear 126 with the gear part 22G of the feed roller 22 and the gear part 21G of the pickup roller 21 in the sheet feeding part 105 will be explained.

As shown in FIG. 5B, when it is at the transmitting position, the idle gear 126 has its gear part 126G engaged with both the gear part 22G of the feed roller 22 and the gear part 21G of the pickup roller 21. Therefore, a driving force is transmitted from an unshown motor to the gear part 22G of the fee roller 22, the sheet feeding part 105 transmits this driving force to the gear part 126G and the gear part 21G in order.

At this time, as shown in FIG. 5B, the sheet feeding part 105 rotates the feed roller 22 in the arrow R1 direction, rotates the idle gear 126 in the arrow R2 direction, and further rotates the pickup roller 21 in the arrow R1 direction. By this, the sheet feeding part 105 can apply a force in the front obliquely upward direction to the sheet P by the pickup roller 21 and the feed roller 22 in the same manner as in the first embodiment.

Figure 7A:
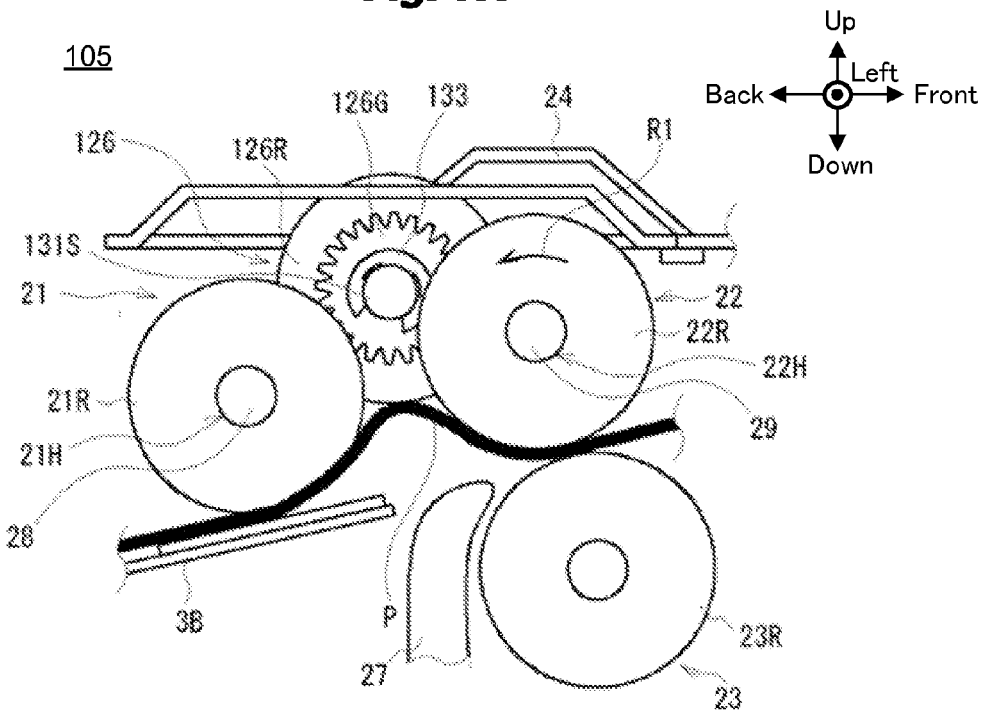
FIGS. 7A-B are schematic diagrams showing suspension of the transmission of a driving force by the second embodiment. The figures illustrate the rotation transmitting part in the releasing position.
Figure 7B:
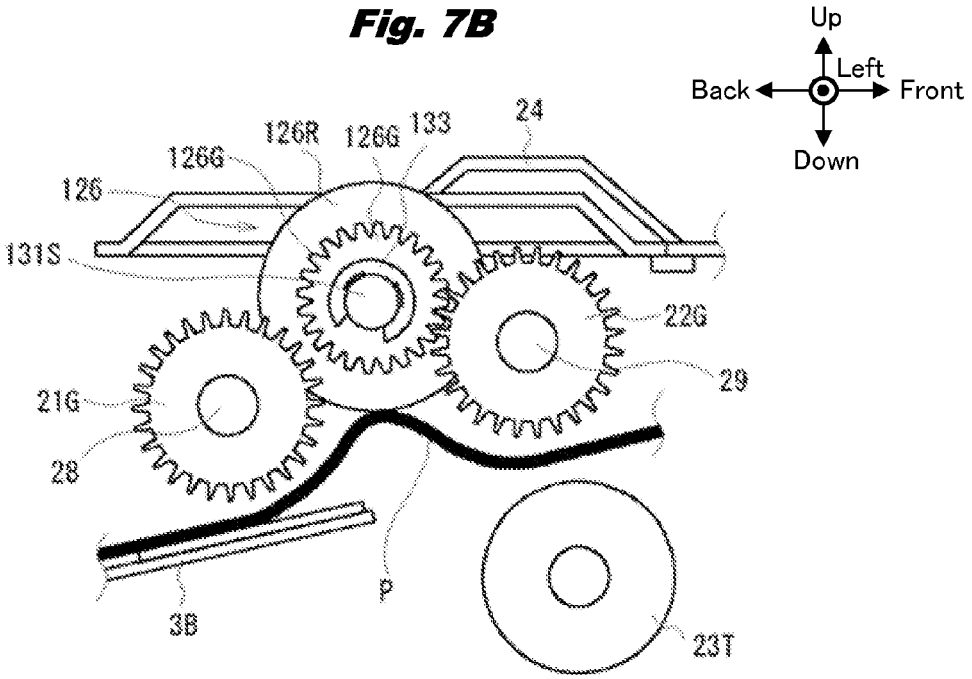

Also, when the sheet P has been bowed in the sheet feeding part 105, as shown in FIG. 5A and the corresponding FIG. 7A, the upper end of the bowed portion of the sheet P contacts with the vicinity of the lower end of the roller part 126R in the idle gear 126 and applies an upward force to the idle gear 126. At this time the idle gear 126 is lifted in the front obliquely upward direction by the swing holder 131 rotating centering on the shaft 29, and as shown in FIG. 7B, releases the engagement of the gear part 126G and the gear part 21G of the pickup roller 21, and stops transmitting the driving force to the gear part 21G.

In other words, the sheet feeding part 105 releases the transmission of a driving force from the gear part 126G to the gear part 21G of the pickup roller according to the bowing of the sheet P by the roller part 126R of the idle gear 126, the swing holder 131, and the shaft 29H (hereafter, altogether called the transmission releasing part TR2).

Then, because the transmission of the driving force stops, the pickup roller 21 stops rotation and stops applying the carrying force to the sheet P. At this time, because a driving force continues to be transmitted from the motor, the feed roller 22 continues to rotate in the arrow R1 direction and apply the carrying force to the sheet P. In other words, in the same manner as in the first embodiment, the sheet feeding part 105 keeps reducing the bowing of the sheet P by stopping the rotation of the pickup roller 21 and continuing the rotation of the feed roller 22.

Also, the lifted-up idle gear 126 has a driving force in the rear downward direction always transmitted to the gear part 126G from the gear part 22G of the feed roller 22. Here, because the idle gear 126 is always pressed onto the stopper 133 by the action of the spring 132 (FIGS. 6A and 6B), a frictional force occurs when rotating, the rotation is suppressed by this friction, and part of the driving force is transmitted to the whole swing holder 131.

In other words, a force to rotate the swing holder 131 in the arrow R1 direction together with the idle gear 126 centering on the shaft 29 acts, which biases the idle gear 126 in the rear downward direction, in other words, in the direction to move it closer to the transmitting position. Also, gravity acts on the idle gear 126 in the same manner as in the first embodiment. Therefore, as the bowing of the sheet P becomes reduced, the idle gear 126 moves closer to the transmitting position due to the actions of these forces.

In due course, when the bowing of the sheet P becomes sufficiently small, the sheet feeding part 105 returns the idle gear 126 to the transmitting position (FIGS. 5A and 5B) and reengages the gear part 126G with the gear part 21G of the pickup roller 21. By this, the sheet feeding part 105 resumes the transmission of the driving force from the gear part 126G to the gear part 21G and resumes the rotation of the pickup roller 21 in the same manner as in the first embodiment.

In this manner, the sheet feeding part 105 is designed, when the sheet P has been bowed, to lift up the idle gear 126 from the transmitting position by this bowed portion of the sheet P and release the engagement of the gear part 126G and the gear part 21G of the pickup roller 21.

2-3. Actions and Effects

In the above configuration, the sheet feeding part 105 of the image forming apparatus 101 according to the second embodiment is designed to hold the idle gear 126 that transmits a driving force from the feed roller 22 to the pickup roller 21 in a rotatable manner centering on the shaft 29 and release the transmission of the driving force to the pickup roller 21 when rotated from the transmitting position.

Therefore, when the sheet P has been bowed, the sheet feeding part 105 can have this bowed portion lift the idle gear 126 upward from the transmitting position and suspend the transmission of the driving force to the pickup roller in the same manner as in the first embodiment. By this, even if the sheet P has been temporarily bowed, because the sheet feeding part 105 can cancel this at any time in the same manner as in the first embodiment again, the occurrence of wrinkles, folds, etc. of the sheet P and jamming of the sheet P can be prevented to feed and carry the sheet P stably.

Especially, because the sheet feeding part 105 is configured so as to rotate the swing holder 131 centering on the shaft 29, regardless of the position of the idle gear 126, its gear part 126G and the gear part 22G of the feed roller 22 can be always maintained in an appropriately engaged state. Therefore, even when the idle gear 126 is greatly lifted up by the bowing of the sheet P, the sheet feeding part 105 can always transmit a sufficient driving force to the idle gear 126.

Also, the sheet feeding part 105 is designed to have friction generated between the idle gear 126 and the stopper 133 when the idle gear 126 rotates centering on the rotation shaft 131S by having the spring 132 press the idle gear 126 onto the stopper 133. Therefore, when transmitting a driving force from the gear part 22G of the feed roller 22 to the gear part 126G of the idle gear 126, the sheet feeding part 105 can apply a force to the entire swing holder 131 in the arrow R1 direction (FIGS. 5A and 5B) centering on the shaft 29, in other words, in the direction to return the idle gear 126 to the transmitting position. In other words, the sheet feeding part 105 can prevent the gear part 126G that is lifted in the front upward direction from the transmitting position and is not engaged with the gear part 21G of the pickup roller 21 from continuing to idle uselessly at that position.

Also, the swing holder 131 has the shaft 29 inserted to the hole 131H. Therefore, when the shaft 29 has rotated in the arrow R1 direction (FIGS. 5A and 5B), the swing holder 131 is biased, although only slightly, in the arrow R1 direction due to friction acting between the hole 131H and this shaft 29.

In other words, when lifted up from the transmitting position, acting on the idle gear 126 are a force based on the driving force applied from the gear part 22G to the gear part 126G and a force due to frictional force acting between the shaft 29 and the hole 131H in addition to its own weight in the same manner as in the first embodiment. By this, with a greater force than in the first embodiment applied in a lifted-up state, the idle gear 126 can make the gear part 126G smoothly engage with the gear part 21G of the pickup roller 21.

In the other respects, also, the sheet feeding part 105 by the second embodiment can achieve the same effects as the sheet feeding part 5 by the first embodiment.

According to the above configuration, when the sheet P has been bowed, the sheet feeding part 105 of the image forming apparatus by the second embodiment has this bowed portion lift the idle gear 126 in the front upward direction from the transmitting position to suspend the transmission of a driving force to the pickup roller 21. By this, the sheet feeding part 105 halts the rotation of the upstream-side pickup roller 21 and also continues the rotation of the downstream-side feed roller 22, which allows cancelling the bowing of the sheet P to prevent damages or jamming of the sheet P for stable feeding.

3. Third Embodiment

In comparison with the image forming apparatus 1 by the first embodiment, although an image forming apparatus 201 (FIG. 1) by the third embodiment is different in having a sheet feeding part 205 replacing the sheet feeding part 5, it is configured in the same manner in the other respects.

3-1. Configuration of the Sheet Feeding Part

Figure 8A:
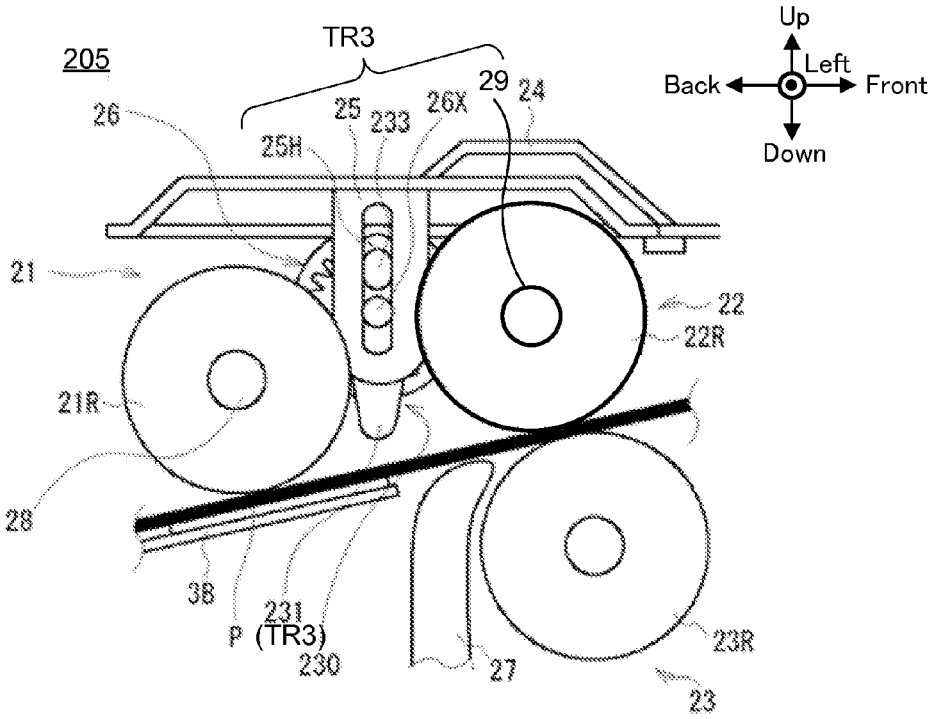
FIGS. 8A-B are schematic diagrams showing the configuration of a sheet feeding part by the third embodiment. The figures illustrate another rotation transmitting part in the transmitting position.
Figure 8B:
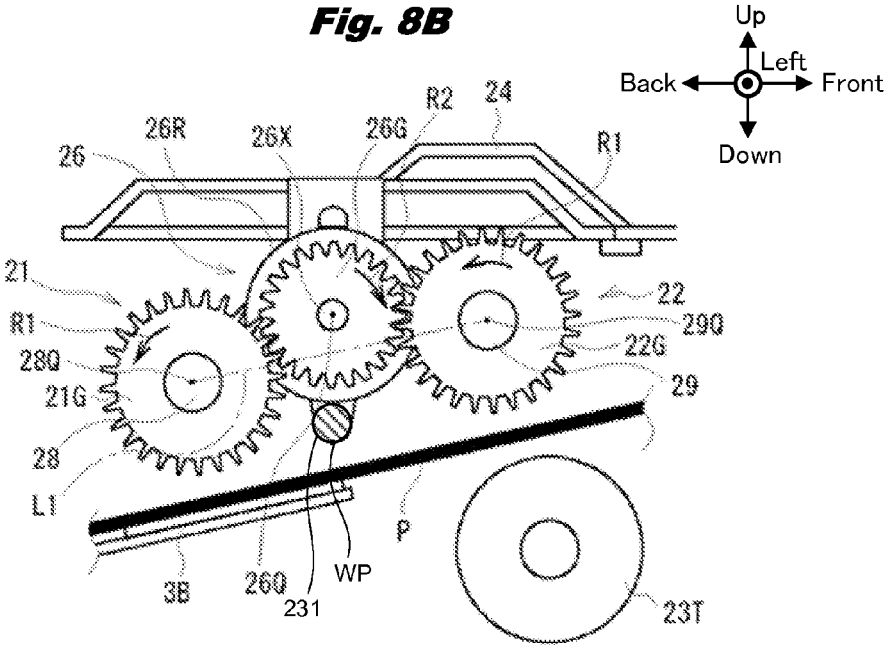
Figure 9:
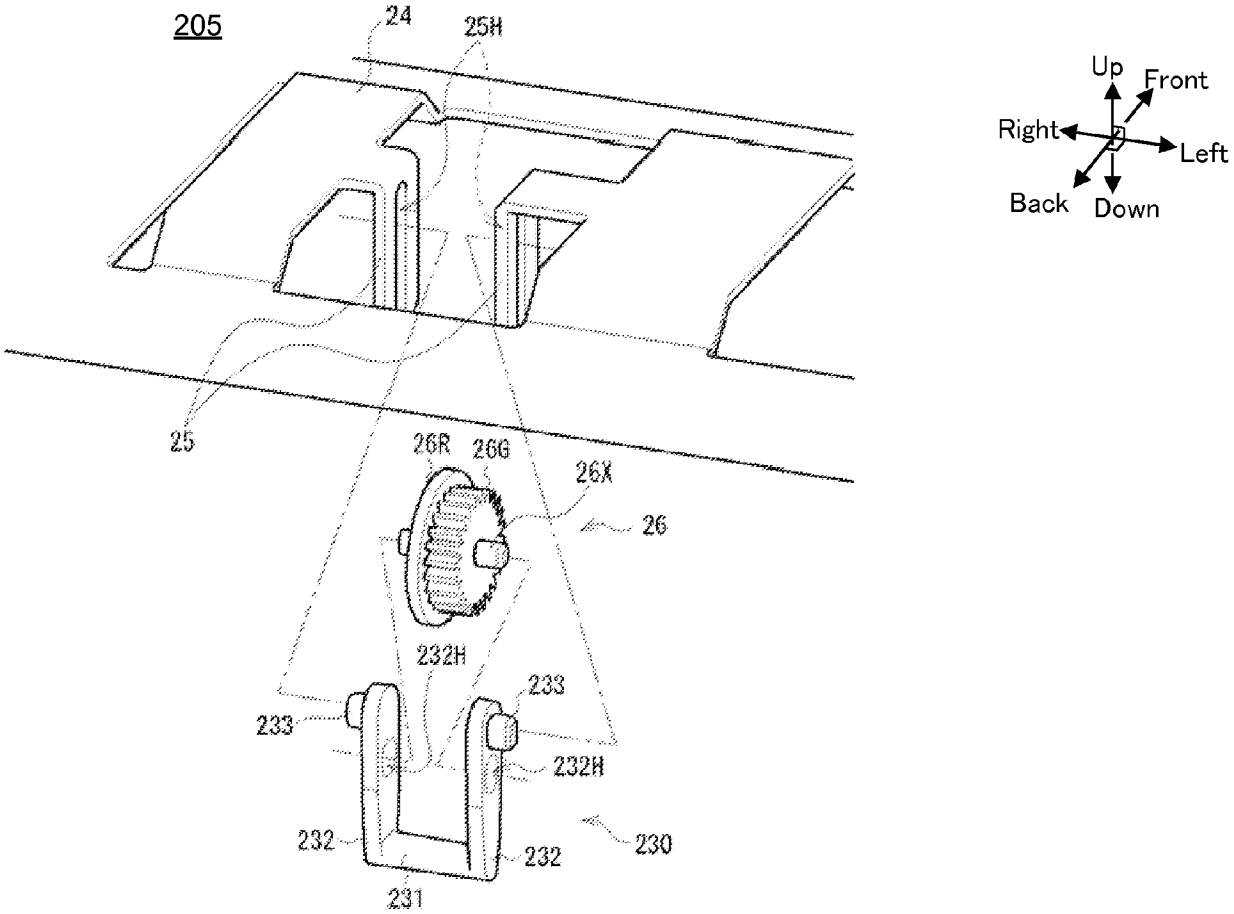
FIG. 9 is a schematic perspective diagram showing the configuration of the sheet feeding part by the third embodiment.

As shown in FIGS. 8A-8B and FIG. 9 corresponding to FIGS. 2A-2B and FIGS. 3A-3B, in comparison with the sheet feeding part 5, although the sheet feeding part 205 is different in that a contact holder 230 has been added and that the interval of the two supporting arms 25 is somewhat expanded, it is configured in the same manner in the other respects.

The contact holder 230 is configured with a contact part 231, two arm parts 232, and two protrusions 233. The contact part 231 is formed in a cylindrical shape having its central axis along the left-right direction. The outer diameter of the contact part 231 is about the same as the outer diameters of the rotation shaft 26X of the idle gear 26 and the shaft 29. Also, the length of the contact part 231 in the left-right direction is slightly longer than the sum of the thicknesses of the gear part 26G and the roller part 26R in the idle gear 26.

Provided on both ends of the contact part 231 are the arm parts 232 extending upward. In other words, two arm parts 232 are connected to the contact part 231 at their respective lower ends. The arm part 232 is formed in an elongated prism shape along the up-down direction, aligning its lower end with the lower end of the contact part 231. Also, to the lower end vicinity of the arm part 232, a so-called rounding treatment is applied to make it a semicircular shape that is continuous with the lower-side circumference of the contact part 231. Furthermore, a rounding treatment is also applied to the upper-end vicinity of the arm part 232 so as to form an upper-lower symmetry with the lower-end vicinity.

Also, bored on somewhat upper side of the middle of each of the arm parts 232 in the up-down direction is a hole 232H penetrating in the left-right direction. The hole 232H viewed from the left-right direction has an elliptical shape elongated somewhat in the up-down direction. The inner diameter in the front-back direction of the hole 232H, in other words the shorter diameter of the long hole is slightly greater than the outer diameter of the rotation shaft 26X in the idle gear 26. Also, the distance from the center of the hole 232H to the upper end of the contact part 231 is shorter than the distance from the center of the rotation shaft 26X to the outermost circumference of the roller part 26R in the idle gear 26.

In the vicinity of the upper end of the outer side face of each of the arm parts 232, in other words the opposite side face of the face connected with the contact part 231, the protrusion 233 is provided. The protrusion 233 is made of a short pillar shape protruding outward in the left-right direction from the arm part 232 and has an elliptical shape elongated in the up-down direction viewed from the left-right direction. The front-back direction width of this protrusion 233 is slightly smaller than the front-back direction width of the insertion hole 25H of the supporting arm 25.

This contact holder 230 holds the idle gear 26 rotatable and movable in the up-down direction by inserting the rotation shaft 26X protruding toward the left and the right of the idle gear 26 to the holes 232H on the left and right arm parts 232. Furthermore, the contact holder 230 is sandwiched between two supporting arms 25 and inserts the right and left protrusions 233 and the rotation shaft 26X of the idle gear 26 to the insertion holes 25H.

By such a configuration, the contact holder 230 can freely rotate the idle gear 26 and also move it in the up-down direction within the range where the protrusions 233 and the rotation shaft 26X of the idle gear 26 are positioned within the insertion holes 25H.

The idle gear 26 descends by the action of gravity, and as shown in FIG. 8B, stops at the position where the gear part 26G is engaged with the gear part 22G of the feed roller 22 and the gear part 21G of the pickup roller 21. Hereafter, the position of the idle gear 26 at this time will be called the transmitting position in this embodiment. Also, although the contact holder 230 descends by its own weight, it stops at the position where the upper end of the hole 232H contacts with the rotation shaft 26X of the idle gear 26. At this time, the contact part 231 is somewhat away from the roller part 26R of the idle gear 26.

Also, the central point 26Q of the rotation shaft 26X when the idle gear 26 is at the transmitting position is positioned above a virtual line L1 connecting the central point 28Q of the shaft 28 and the central point 29Q of the shaft 29 in the same manner as in the first embodiment. Besides, for the convenience of explanation, in FIG. 8B the contact part 231 is depicted with its cross section.

3-2. Engagement of the Idle Gear

Next, the engagement of the gear part 26G of the idle gear 26 with the gear part 22G of the feed roller 22 and the gear part 21G of the pickup roller 21 in the sheet feeding part 205 will be explained.

As shown in FIG. 8B, when it is at the transmitting position, the idle gear 26 rotates the feed roller 22 by transmitting the driving force transmitted from the gear part 22G of the feed roller 22 to the gear part 21G of the pickup roller 21 in the same manner as in the first embodiment.

Figure 10A:
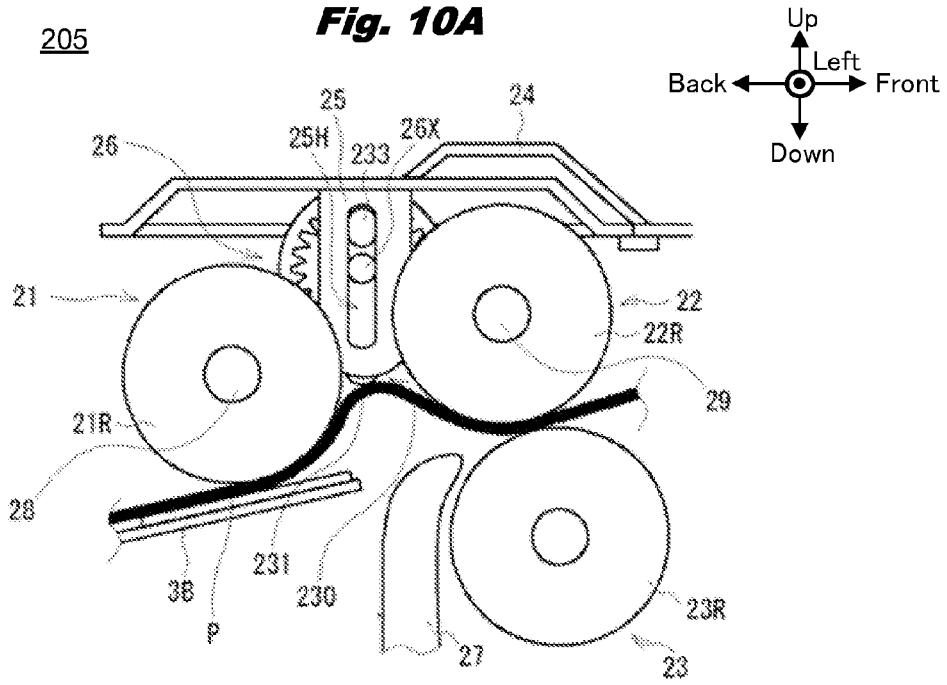
FIGS. 10A-B are schematic diagrams showing suspension of the transmission of a driving force by the third embodiment. The figures illustrate the rotation transmitting part in the releasing position.
Figure 10B:
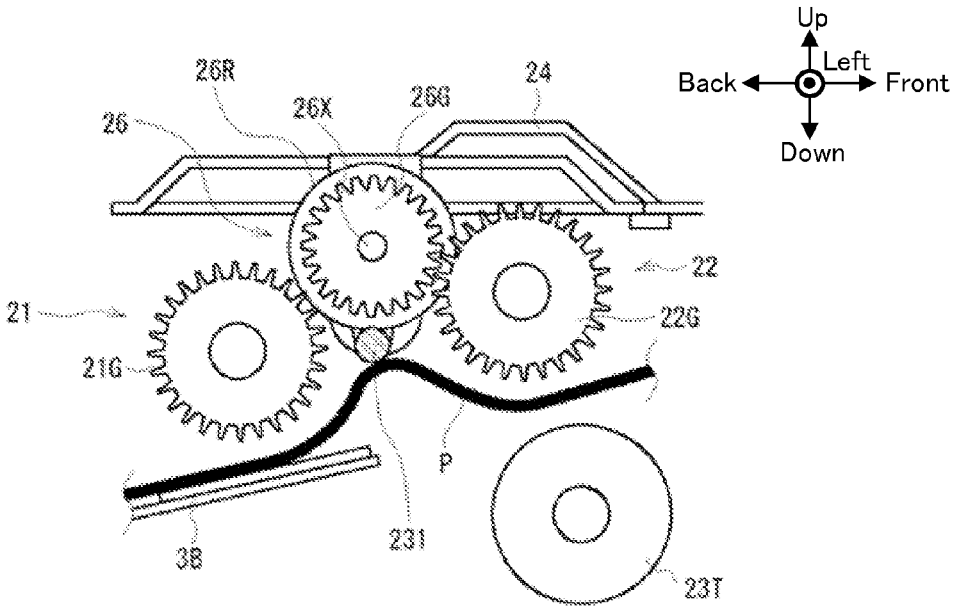
Figure 11B:
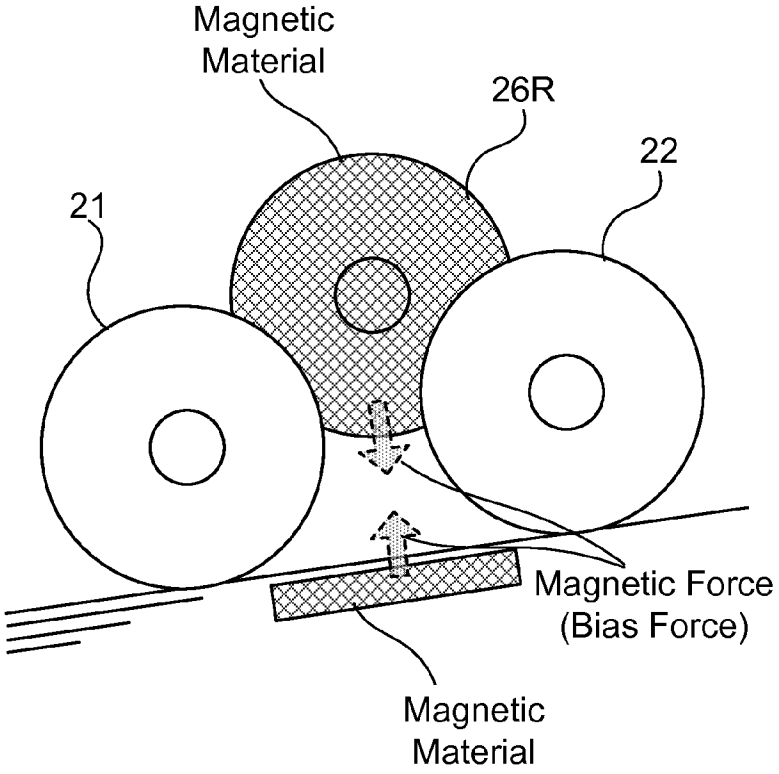
FIGS. 11A-B are schematic diagrams showing other embodiments of the bias force.
Figure 11A:
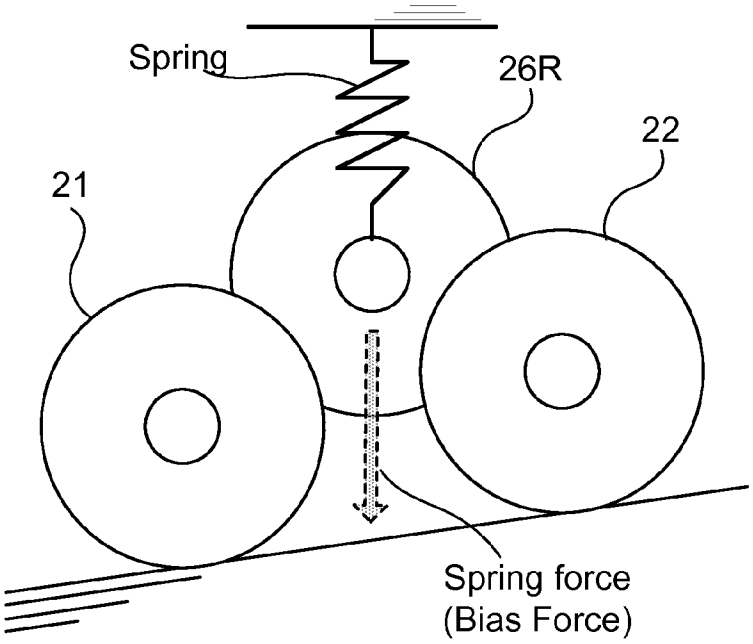

Also, when the sheet P has been bowed in the sheet feeding part 205, as shown in FIG. 10A corresponding to FIG. 8A, the upper end of the bowed portion of the sheet P contacts with the contact part 231 of the contact holder 230 and first lifts the contact holder 230 upward. As shown in FIG. 10B, the contact holder 230 has the upper side of the contact part 231 contact with the lower end portion of the roller part 26R of the idle gear 26, thereby applying an upward force to and lifting up the idle gear 26. At this time, the idle gear 26 releases the engagement of the gear part 26G with the gear part 21G of the pickup roller 21 and stops transmitting the driving force to the gear part 21G.

In other words, the sheet feeding part 205 releases the transmission of a driving force from the gear part 26G to the gear part 21G of the pickup roller 21 according to the bowing of the sheet P by the contact holder 230, the supporting arm 25, the rotation shaft 26*x* and the insertion holes 25H (hereafter, altogether called the transmission releasing part TR3).

Then, because the driving force stops being transmitted, the pickup roller 21 stops its rotation and applying a carrying force to the sheet P. At this time, because the driving force continues to be transmitted from the motor, the feed roller 22 continues to rotate and apply a carrying force to the sheet P. In other words, the sheet feeding part 205 keeps reducing the bowing of the sheet P by stopping the rotation of the pickup roller 21 and continuing the rotation of the feed roller 22 in the same manner as in the first and second embodiments. Accompanying this, the sheet feeding part 205 lowers the contact holder 230 and the idle gear 26 lifted up by the sheet P, moving them closer to the transmitting position.

In due course, once the bowing of the sheet P has become sufficiently small, the sheet feeding part 205 lowers the idle gear 26 to the transmitting position (FIGS. 8A, 8B) and reengages the gear part 26G with the gear part 21G of the pickup roller 21. By this, the sheet feeding part 205 resumes the transmission of the driving force from the gear part 26G to the gear part 21G and resumes the rotation of the pickup roller 21.

In this manner, the sheet feeding part 205 is designed, when the sheet P has been bowed, to lift up the idle gear 26 from the transmitting position by this bowed portion of the sheet P via the contact holder 230 and release the engagement of the gear part 26G and the gear part 21G of the pickup roller 21.

3-3. Actions and Effects

In the above configuration, the sheet feeding part 205 of the image forming apparatus 201 of the third embodiment has the idle gear 26 transmitting a driving force from the feed roller 22 to the pickup roller 21 held by the contact holder 230 in a rotatable manner. Also, the sheet feeding part 205 is designed to release the transmission of the driving force to the pickup roller 21 when the idle gear 26 is lifted up from the transmitting position via the contact holder 230

Therefore, when the sheet P has been bowed, the sheet feeding part 205 can have this bowed portion lift the idle gear 26 upward from the transmitting position and suspend the transmission of the driving force to the pickup roller 21 in the same manner as in the first embodiment. By this, even if the sheet P has temporarily been bowed, because the sheet feeding part 205 can cancel this at any time in the same manner as in the first embodiment, the occurrence of wrinkles, folds, etc. of the sheet P and jamming of the sheet P can be prevented to feed and carry the sheet P stably.

Especially, the sheet feeding part 205 has the contact part 231 of the contact holder 230 positioned below the lower end of the roller part 26R in the idle gear 26 and has the contact part 231 contact with the bowed portion of the sheet P. Therefore, even if no sufficient space can be secured around the idle gear 26 and the diameter of the roller part 26R cannot be enlarged, the sheet feeding part 205 can have the bowing of the sheet P contact with the contact part 231 and have it lift up the idle gear 26, starting at a stage where the bowing is relatively small.

Also, the sheet feeding part 205 has the contact part 231 disposed so as to traverse in the left-right direction right under the gear part 26G in the idle gear 26. Therefore, the sheet feeding part 205 can prevent the contact between the bowed portion of the sheet P and the gear part 26G and prevent adherence of dirt, damage, etc. of the sheet P caused by the gear part 26G.

Furthermore, the contact holder 230 has the protrusion 233 formed in an elliptical shape viewed in the left-right direction and further has the rotation shaft 26X of the idle gear 26 inserted to the insertion holes 25H of the supporting arms 25. By this, the sheet feeding part 205 can prevent the rotation of the contact holder 230, always position the contact part 231 right under the idle gear 26, in other words, right under the rotation shaft 26X, and receive the upward force applied by the bowing of the sheet P without a loss.

In the other respects also, the sheet feeding part 205 by the third embodiment can achieve the same effects as the sheet feeding part 5 by the first embodiment.

According to the above configuration, when the sheet P has been bowed, the sheet feeding part 205 of the image forming apparatus 201 by the third embodiment has this bowing lift the contact holder 230 and the idle gear 26 upward from the transmitting position and suspend the transmission of the driving force to the pickup roller 21. By this, the sheet feeding part 205 halts the rotation of the upstream-side pickup roller 21 and also continues the rotation of the downstream-side feed roller 22, which allows cancelling the bowing of the sheet P to prevent damages or jamming of the sheet P for stable feeding.

4. Other Embodiments

Besides, in the first embodiment described above, described was the case where only the gear part 26G of the idle gear 26 was placed between the gear 22 of the feed roller 22 and the gear part 21G of the pickup roller 21, and the transmission of a driving force was released by having this bowing of the sheet P lift up this idle gear 26. However, the invention is not limited to this, but for example, multiple gears may be placed between the gear part 22 of the feed roller 22 and the gear part 21 of the pickup roller 21 and part or all of these gears may be lifted up by the bowing of the sheet P. The same also applies to the second and the third embodiments.

Figure 13:
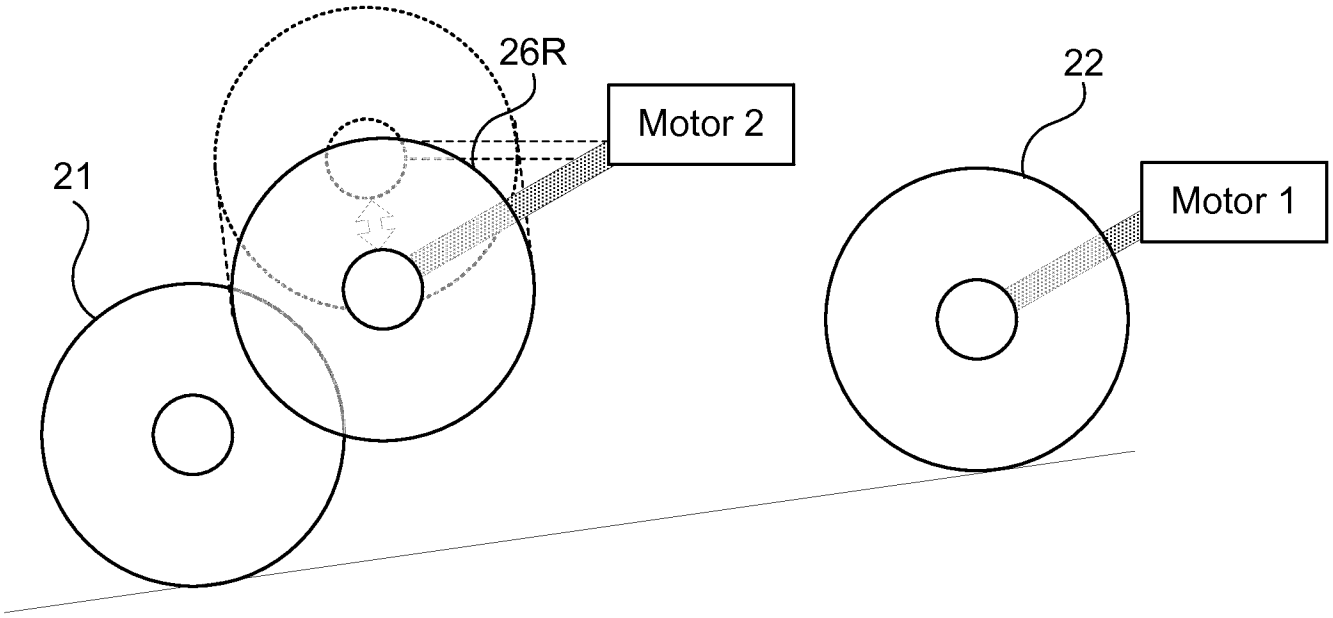
FIG. 13 is a schematic diagram showing another embodiment that includes two motors (motor 1 and motor 2) that are independently equipped. Motor 1 is for roller 22 and Motor 2 is for roller 26. A first driving force to roller 22, which is as the second roller, is generated by motor 1. A second driving force to roller 21, which is as the first roller, is generated by motor 2. Motor 1 works as a first driving force source. Motor 2 works as a second driving force source.

Also, in the first embodiment described above, described was the case where a driving force is transmitted from the feed roller 22 that receives a driving force from a motor, see FIG. 12, to the pickup roller 21 via the idle gear 26. However, the invention is not limited to this structure; but for example, the driving force may be transmitted to the pickup roller 21 via a gear from another motor than the motor that supplies a driving force to the feed roller 22, see FIG. 13. In this case, the gear that transmits the driving force to the pickup roller 21 may be configured in the same manner as the idle gear 26, and the transmission of the driving force may be suspended by the gear being lifted upward from the transmitting position by a bowing of the sheet P. The same also applies to the second and the third embodiments.

Furthermore, in the first embodiment described above, described was the case where the lifted-up idle gear 26 is returned to the transmitting position by the action of gravity on the idle gear 26. However, the invention is not limited to this, but for example, the idle gear 26 may be biased downward by a bias member such as a spring. In this case, by setting the bias force relatively weak so that the idle gear 26 can be lifted upward from the transmitting position by a bowing of the sheet P. The same also applies to the second and the third embodiments.

Furthermore, in the first embodiment described above, described was the case where the idle gear 26 is disposed above the carrying path of the sheet P, and the engagements of the gears are released by having the sheet P bowed upward and lift the idle gear 26 upward from the transmitting position. However, the invention is not limited to this, but for example, the idle gear 26 may be disposed below the carrying path of the sheet P, and the engagements of the gears may be released by having the sheet P bowing downward and push the idle gear 26 downward from the transmitting position. Alternatively, in the place where the carrying path is formed along various directions such as the up-down direction, the idle gear 26 may be disposed in the vicinity of the carrying path, and the engagements of the gears may be released by having the bowing of the sheet P move the idle gear 26 in the direction to move it away from the carrying path such as the front-back direction. In these cases, the idle gear 26 only needs to be biased by a bias member such as a spring toward the carrying path, in other words, the transmitting position. The same also applies to the second and the third embodiments.

Furthermore, in the first embodiment described above, described was the case where the insertion hole 25H made of a long hole along the up-down direction is provided on each of the supporting arms 25, and the idle gear 26 is moved in the up-down direction by moving the rotation shaft 26X along this insertion hole 25H. However, the invention is not limited to this, but for example, the idle gear 26 may be moved along various lines by various methods such that the idle gear 26 is moved in along an arc-shape track centering on a specified rotation shaft or that the idle gear 26 is moved along a specified curve by utilizing a commonly-known link mechanism. In short, it suffices that a driving force can be transmitted from the gear part 26G to the gear part 21G of the pickup roller at the transmitting position, and that the idle gear 26 can be moved from this transmitting position by a bowing of the sheet P to release the transmission of the driving force. The same also applies to the third embodiment.

Furthermore, in the first embodiment described above, described was the case where the engagements of the gears are released by having the idle gear 26 moved upward which is the direction to move away from the carrying path of the sheet P. However, the invention is not limited to this, but for example, the engagements of the gears may be released by moving the idle gear 26 in various directions such as the parallel direction to the sheet P plane by converting the upward force by the bowing of the sheet P into a force in the left-right direction, front-back direction, or an oblique direction using a member that rotates centering on a fulcrum in a similar manner to a lever. In this case, it suffices that the idle gear 26 is supported by a supporting member replacing the supporting arms 25 in a manner that allows moving away from the transmitting position and is biased toward the transmitting position by a bias member such as the spring 132 in the second embodiment.

Furthermore, in the first embodiment described above, described was the case where, when the idle gear 26 is at the transmitting position, the central point 26Q of the rotation shaft 26X is positioned above the virtual line L1 connecting the central point 28Q of the shaft 28 and the central point 29Q of the shaft 29. However, the invention is not limited to this, but when the idle gear 26 is at the transmitting position, the central point 26Q may be positioned on the line L1. In this case, for example, it suffices that the idle gear 26 is prevented from escaping downward by the driving force from the feed roller 22, in other words, from releasing the engagement between the gear part 21G of the pickup roller 21 and the gear part 26G by forming the lower end of the insertion hole 25H in each of the supporting arms 25 aligned to the rotation shaft 26X positioned in this transmitting position. The same also applies to the second and the third embodiments.

Furthermore, in the second embodiment described above, described was the case where the idle gear 126 is biased by the spring 132 against the stopper 133. However, the invention is not limited to this, but for example, when the friction between the idle gear 126 and the rotation shaft 131S is relatively large, the spring 132 may be omitted.

Furthermore, in the third embodiment described above, described was the case where the roller part 26R having a larger diameter than the gear part 26G is provided in the idle gear 26. However, the invention is not limited to this, but for example, the roller part 26R having a smaller diameter than the gear part 26G may be provided in one or both of the gear parts 26G, or the roller part 26R may be omitted from the idle gear 26. In other words, in the third embodiment, because the contact holder 230 contacts with the sheet P, the contact between the gear part 26G and the sheet P does not need to be considered, and it suffices that the gear part 26G can smoothly rotate without being caught by the arm part 232 of the contact holder 230. In this case, it suffices that the interval between the lower end of the hole 232H and the contact part 231 is set larger than the outer diameter of the gear part 26G so that the gear part 26G will not contact with the contact part 231.

Furthermore, in the third embodiment described above, described was the case where the rotation shaft 26X of the idle gear 26 is inserted to the insertion holes 25H of the supporting arms 25 in addition to the holes 232H formed on the arm parts 232 of the contact holder 230. However, the invention is not limited to this, but for example, the rotation shaft 26X may be configured short so as to be inserted only to the holes 232H and not to the supporting arms 25.

Furthermore, in the third embodiment described above, described was the case where the holes 232H provided on the arm parts 230 of the contact holder 230 are made in a long hole shape elongated in the up-down direction so that the rotation shaft 26X of the idle gear 26 can be moved in the up-down direction within the holes 232H, in other words, the idle gear 26 is made movable in the up-down direction relative to the contact holder 230. However, the invention is not limited to this, but for example, the holes 232H may be made as round holes and the idle gear 26 may not be moved in the up-down direction relative to the contact holder 230 but moved in the up-down direction together as one unit by a bowing of the sheet P.

Furthermore, in the first embodiment described above, described was the case where this invention is applied to the sheet feeding part 5 that separates and feeds the sheet P contained in the sheet feeding cassette 3. However, the invention is not limited to this but may be applied, for example, to various places such as the lower carrying part 6 and the upper carrying part 15 where the sheet P is carried by being handed over between multiple sets of roller pairs. The same also applies to the second and the third embodiments.

Furthermore, in the first embodiment described above, described was the case where the idle gear 26 is moved from the transmitting position by transmitting a force arising only by a bowing of the sheet P. However, the invention is not limited to this, but for example, the bowing of the sheet P may be detected by an optical sensor or the like, and the idle gear 26 is moved from the transmitting position by an actuator or the like. The same also applies to the second and the third embodiments.

Furthermore, in the first embodiment described above, described was the case where this invention is applied to the image forming apparatus 1 that forms an image while carrying the sheet P as a medium inside. However, the invention is not limited to this but may be applied, for example, to various devices that carry various media having flexibility such as bills, postcards, and tickets. For the sheet P of the invention, roll paper which is in a single long sheet rolled around a core may be available to the invention.

Furthermore, the invention is not limited to the embodiments described above or other embodiments. In other words, the applicability scope of the invention includes any embodiment that arbitrarily combines part or the whole of the embodiments described above and other embodiments, and embodiments extracted as part of them.

Furthermore, in the first embodiment described above, described was the case where the sheet feeding part 5 as the medium carrying device comprises the pickup roller 21 as the first roller, the feed roller 22 as the second roller, the gear part 26G as the rotation transmitting part, and the roller part 26R, the rotation shaft 26X, the supporting arms 25, and the insertion holes 25H as the transmission releasing part. However, the invention is not limited to this, but the medium carrying device may comprise the first roller, the second roller, the rotation transmitting part, and the transmission releasing part having other kinds of configurations. Referring to the embodiments, the transmission releasing parts according to the first to third embodiments are respectively denoted with TR1 in FIG. 2A, TR2 in FIG. 5A and TR3 in FIG. 8A.

This invention may also be utilized in an image forming apparatus that feeds and carries a sheet of paper having flexibility stacked in a sheet cassette and forms an image.

What is claimed is:

1. A medium carrying device that carries a medium, which is flexible, in a carrying direction along a carrying path from an upstream side to a downstream side, comprising:

a first roller that is rotatable and located at the carrying path to carry the medium along the carrying path, the first roller being an idle roller;

a second roller that is rotatable, located at the carrying path and at the downstream side from the first roller in the carrying direction, the second roller driving its rotation by a first driving force transmitted from a first driving force source;

a rotation transmitting part that drives its rotation by a second driving force transmitted from a second driving force source, and moves between at a transmitting position and at a releasing position, at the transmitting position, the rotation transmitting part is positioned close to the carrying path in a perpendicular direction with respect to the carrying direction, contacting the first roller, and transmitting the second driving force to the first roller so that the first roller is driven by the second driving force, at the releasing position, the rotation transmitting part is positioned distant from the carrying path in the perpendicular direction with respect to the carrying direction, not contacting the first roller so that the first roller is not driven by the second driving force, a transmission releasing part that is positioned between the first and second rollers in the carrying direction, being connected to the rotation transmitting part, wherein when the medium is bowed between the first and second rollers, the transmission releasing part moves the rotation transmitting part from the transmitting position to the releasing position according to the bowing of the medium.

2. The medium carrying device according to claim 1, wherein the first driving force source and the second driving force source are configured in a single unit.

3. The medium carrying device according to claim 1, wherein when the bowing disappears, the transmission releasing part moves the rotation transmitting part from the releasing position to the transmitting position.

4. The medium carrying device according to claim 1, wherein the transmission releasing part is moved to the releasing position by a bowed portion of the medium toward away from the carrying path.

5. The medium carrying device according to claim 2, wherein the second roller and the rotation transmitting part are connected, and the second driving force to the rotation transmitting part is transmitted from the second roller.

6. The medium carrying device according to claim 5, further comprising:

a swing body configured rotatable along the same shaft as the second roller rotates, and a rotation supporting part that is provided with the swing body and rotatably supports the rotation transmitting part, wherein the rotation transmitting part is biased toward the transmitting position using the second driving force transmitted to the rotation transmitting part from the second roller.

7. The medium carrying device according to claim 6, further comprising:

a fixing part fixed to the rotation supporting part, and a frictional action part that biases the rotation transmitting part to the fixing part and has a frictional force act.

8. The medium carrying device according to claim 1, further comprising:

a bias part that generates a bias force the rotation transmitting part toward the transmitting position, wherein when the medium is bowed between the first and second rollers, the transmission releasing part moves the rotation transmitting part to the releasing position withstanding the bias force by a force toward a direction that a bowed portion of the medium is oriented away from the carrying path.

9. The medium carrying device according to claim 8, wherein the bias part is a spring that is attached to the rotation transmitting part, and the bias part biases the rotation transmitting part toward the transmitting position using the bias force generated from the spring.

10. The medium carrying device according to claim 2, wherein when the bowing disappears, the rotation transmitting part returns to the transmitting position by its weight using gravity.

11. The medium carrying device according to claim 1, wherein the rotation transmitting part has a cogwheel part that engages with cogwheel parts respectively provided with the first roller and the second roller, and the transmission releasing part is attached to the rotation transmitting part in order to move together, and includes a disk that shares a central shaft with the cogwheel part of the rotation transmitting part and has a larger diameter than the cogwheel part so that the bottom portion of the disk contacts a bowed portion of the medium.

12. The medium carrying device according to claim 1, wherein the rotation transmitting part has a cogwheel part that engages with cogwheel parts respectively provided with the first roller and the second roller, and the transmission releasing part moves together with the rotation transmission part while rotatably holding the rotation transmitting part, and includes a contact part that is provided at a position closer to the carrying path than the rotation transmitting part, and contacts with a bowed portion of the medium.

13. The medium carrying device according to claim 1, wherein when the rotation transmitting part is at the transmitting position, a rotation center of the rotation transmitting part is positioned farther than a virtual line connecting rotation centers of the first roller and the second roller from the carrying path.

14. The medium carrying device according to claim 1, further comprising:

a medium guide that prevents the medium from bowing to the opposite side of the rotation transmitting part from the carrying path.

15. An image forming apparatus, comprising an image forming part that forms an image on the medium and the medium carrying device according to claim 1.

* * * * *